US009880485B2

(12) United States Patent
Kagawa

(10) Patent No.: US 9,880,485 B2
(45) Date of Patent: Jan. 30, 2018

(54) IMAGE FORMING APPARATUS

(71) Applicant: CANON KABUSHIKI KAISHA, Tokyo (JP)

(72) Inventor: Yosuke Kagawa, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/963,413

(22) Filed: Dec. 9, 2015

(65) Prior Publication Data

US 2016/0187802 A1 Jun. 30, 2016

(30) Foreign Application Priority Data

Dec. 25, 2014 (JP) ..... 2014-263347

(51) Int. Cl.
*G03G 15/02* (2006.01)
*G03G 15/01* (2006.01)
*G03G 15/00* (2006.01)

(52) U.S. Cl.
CPC ..... *G03G 15/0266* (2013.01); *G03G 15/0189* (2013.01); *G03G 15/80* (2013.01)

(58) Field of Classification Search
CPC ..... G03G 15/0266; G03G 15/80
See application file for complete search history.

(56) References Cited

U.S. PATENT DOCUMENTS

2003/0219265 A1* 11/2003 Matsumoto ..... G03G 15/086 399/38
2006/0250918 A1* 11/2006 Hsu ..... G11B 7/004 369/59.11
2007/0052484 A1* 3/2007 Chen ..... H03F 3/217 331/2
2007/0059016 A1* 3/2007 Sato ..... G03G 15/80 399/88
2008/0050143 A1* 2/2008 Barry ..... G03G 15/0283 399/89

(Continued)

FOREIGN PATENT DOCUMENTS

JP 06202445 A * 7/1994
JP H07-241083 9/1995

(Continued)

OTHER PUBLICATIONS

Machine translations of Matsukuma (1994) and Nakai (1996).*

*Primary Examiner* — Sevan A Aydin
(74) *Attorney, Agent, or Firm* — Fitzpatrick, Cella, Harper & Scinto

(57) ABSTRACT

An image forming apparatus comprises a plurality of image forming units that respectively form an image, and a plurality of voltage generation circuits that respectively generate voltages for driving the plurality of image forming units. Each of the plurality of voltage generation circuits comprises a voltage generation circuit having a transformer, and generates a voltage by a switching operation that is driven by changing an input voltage of primary side of the transformer, an oscillation circuit that generates a clock signal of a frequency that becomes a reference frequency of the switching operation and a setting unit that sets the frequency of the clock signal that the oscillation circuit generates. The setting units of the plurality of voltage generation circuits set the frequencies of the respective clock signals.

14 Claims, 20 Drawing Sheets

(56) References Cited

U.S. PATENT DOCUMENTS

| | | | | |
|---|---|---|---|---|
| 2008/0267653 | A1* | 10/2008 | Ushio | G03G 21/14 399/77 |
| 2011/0135338 | A1* | 6/2011 | Yamamoto | H02M 3/335 399/88 |
| 2013/0154730 | A1* | 6/2013 | Anazawa | H03F 3/68 330/124 R |
| 2014/0086611 | A1* | 3/2014 | Nakagawa | G03G 15/80 399/88 |
| 2014/0219676 | A1* | 8/2014 | Sato | G03G 15/80 399/88 |
| 2014/0294410 | A1* | 10/2014 | Hayashi | G03G 21/203 399/44 |
| 2016/0187802 | A1* | 6/2016 | Kagawa | G03G 15/0189 399/89 |

FOREIGN PATENT DOCUMENTS

| | | | | |
|---|---|---|---|---|
| JP | 08036431 | A | * | 2/1996 |
| JP | 2012063416 | A | * | 3/2012 |
| JP | 2013-065932 | | | 4/2013 |

* cited by examiner

CLOCK SIGNALS THAT OSCILLATION CIRCUIT 411 OUTPUTS UPON IMAGE FORMATION

CLOCK SIGNALS THAT OSCILLATION CIRCUIT 411 OUTPUTS WHEN IMAGE FORMING APPARATUS IS IN STANDBY

IMAGE FORMING APPARATUS

BACKGROUND OF THE INVENTION

Field of the Invention

The present invention relates to an image forming apparatus.

Description of the Related Art

In an electrophotographic image forming apparatus, charging of a surface of a photosensitive drum is performed uniformly by a charger, and the charged surface of the photosensitive drum is exposed by a laser beam which is modulated in accordance with image data and irradiated by an exposure unit, thereby forming an electrostatic latent image. Then, by a developer (hereinafter referred to as a toner) supplied from a developing unit, the electrostatic latent image is developed and a toner image is thereby formed.

For photosensitive drum surface charge processing, an AC charging scheme that charges by causing a charging roller to abut the surface of the photosensitive drum, for example, applying a voltage that overlaps a direct current voltage and an alternating voltage to the charging roller, and discharging to the surface of the photosensitive drum is employed. In this AC charging scheme, the surface of the photosensitive drum can be charged uniformly because discharge to the positive side and to the negative side occurs alternatingly because voltage that overlaps an alternating voltage on a direct current voltage is applied.

A class-D amplifier is used for an alternating voltage generation circuit for generating an alternating voltage applied to this charging roller. This class-D amplifier converts an input signal into a pulse width modulation signal (a PWM signal), and drives a bridge circuit by the PWM signal. With this, compared to a conventional analog amplification scheme, the amplification signal can be obtained with high efficiency. With such an alternating voltage generation circuit, a high-voltage alternating voltage is caused to occur on a secondary side of a transformer by driving a primary side of the transformer by a class-D amplifier output (refer to Japanese Patent Laid-Open No. 2013-65932, Japanese Patent Laid-Open No. H7-241083, for example).

However, because the class-D amplifier performs switching driving of a bridge circuit at a high frequency, a radiation noise occurs, and because a ferrite bead or a filter is used as a noise counter-measure, this leads to a cost increase. Also, if the class-D amplifier is used by a charging high-voltage circuit of a color image forming apparatus having 4 image forming units for yellow, magenta, cyan, and black, it is necessary to charge each photosensitive drum for the four colors. For this reason, there is the problem that the frequencies of the PWM signals of the class-D amplifiers used corresponding to respective color photosensitive drums overlap, and radiation noise worsens.

SUMMARY OF THE INVENTION

An aspect of the present invention is to eliminate the above-mentioned problems with the conventional techniques.

A feature of the present invention is to provide a technique of, in an image forming apparatus having a plurality of image forming units, suppressing a noise peak to be lower by causing noise that occurs in the plurality of image forming units to not overlap.

According to a first aspect of the present invention, there is provided an image forming apparatus comprises a plurality of image forming units configured to respectively form an image, and a plurality of voltage generation units configured to respectively generate voltages for driving the plurality of image forming units, wherein each of the plurality of voltage generation units comprises: a voltage generator having a transformer, configured to generate a voltage by a switching operation that is driven by changing an input voltage of primary side of the transformer; a clock generation unit configured to generate a clock signal of a frequency that becomes a reference frequency of the switching operation; and a setting unit configured to set the frequency of the clock signal that the clock generation unit generates, wherein the setting units of the plurality of voltage generation units set the frequencies of the respective clock signals so that the frequencies of the clock signals that the plurality the clock generation units generate are different from each other.

According to a second aspect of the present invention, there is provided an image forming apparatus comprises a plurality of image forming units configured to respectively form an image, and a plurality of voltage generation units configured to respectively generate voltages for driving the plurality of image forming units, wherein each of the plurality of voltage generation units comprises: a voltage generator having a transformer, configured to generate a voltage by a switching operation that is driven by changing an input voltage of primary side of the transformer; a clock generation unit configured to generate a clock signal of a frequency that becomes a reference frequency of the switching operation; a setting unit configured to set the frequency of the clock signal that the clock generation unit generates; and a control unit configured to control so that the frequencies of the clock signals are set by the setting unit to values that are different from each other when the image forming apparatus is in image forming and in a standby state in which the image forming apparatus is waiting for start of image forming.

Further features of the present invention will become apparent from the following description of exemplary embodiments with reference to the attached drawings.

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE EMBODIMENTS

Embodiments of the present invention will now be described hereinafter in detail, with reference to the accompanying drawings. It is to be understood that the following embodiments are not intended to limit the claims of the present invention, and that not all of the combinations of the aspects that are described according to the following embodiments are necessarily required with respect to the means to solve the problems according to the present invention.

[First Embodiment]

Figure 1:
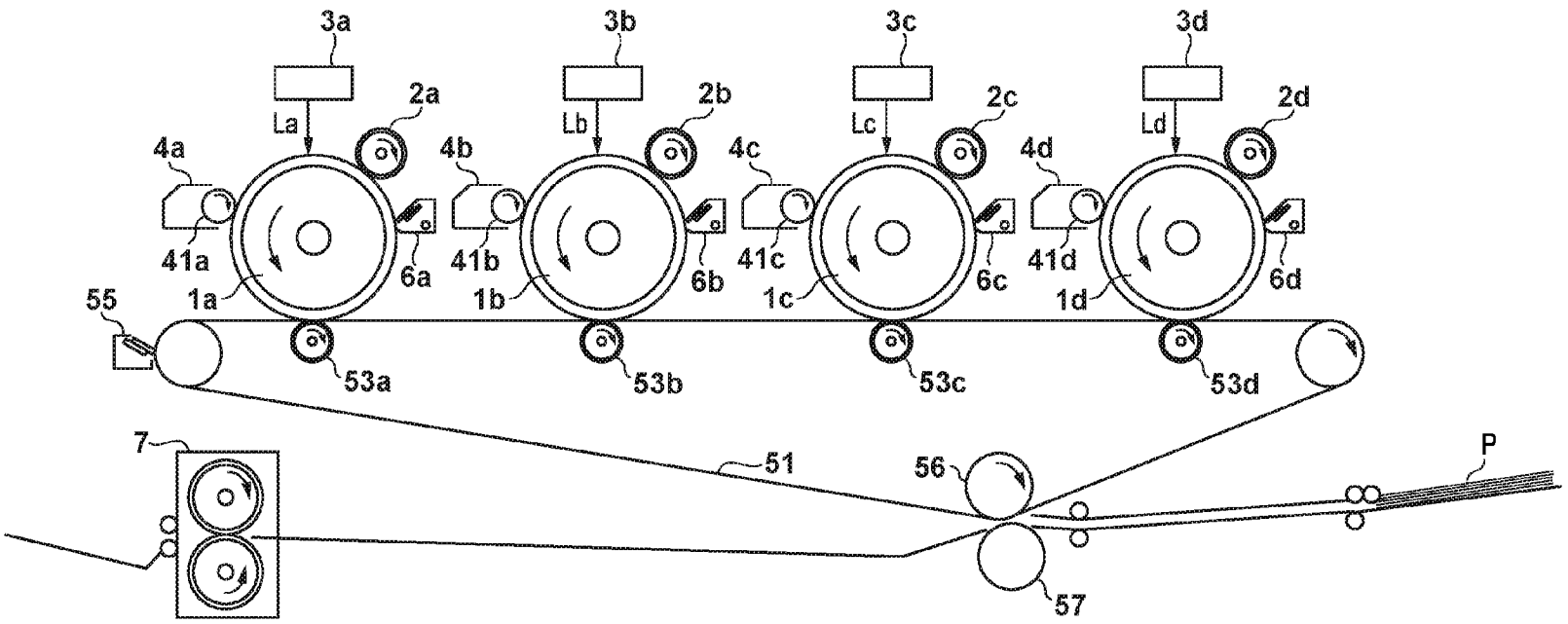
FIG. 1 depicts a view for explaining a configuration of an image forming unit of a color image forming apparatus according to a first embodiment of the present invention.

FIG. 1 depicts a view for explaining a configuration of an image forming unit of a color image forming apparatus according to a first embodiment of the present invention.

This color image forming apparatus is an image forming apparatus for forming an image using a electrophotographic process comprising a high-voltage power supply circuit for charging. This color image forming apparatus comprises of four image forming units (stations) of yellow, magenta, cyan, and black. In the figure, a to d added after reference numerals correspond to each image forming unit from yellow, magenta, cyan, and black. Explanation is given omitting a to d in the explanation of FIG. 1. A charging roller 2, a developing unit 4, a cleaner 6, and a primary transfer roller 53 are arranged in a periphery of a drum of a photoconductive member 1. An exposure unit 3 generates a laser beam in accordance with image data of each color and irradiates a surface of each corresponding photoconductive member 1. The developing unit 4 comprises a developing sleeve 41 internally, contains a toner functioning as a developer, and forms a visualized toner image by causing an electrostatic latent image formed on each corresponding photosensitive member 1 to absorb the toner. In this way, a toner image formed on the photoconductive member 1 corresponding to each color is overlapped and transferred on an intermediate transfer belt 51 by the primary transfer roller 53, and the color image transferred on the intermediate transfer belt 51 is transferred to a recording material P such as a paper or an OHP sheet by secondary transfer rollers 56 and 57. In this way, the recording material P on which a color toner image is transferred is transmitted to a fixing unit 7 and the transferred toner image is fixed to the recording material P. L denotes a laser beam for exposing the photoconductive member 1.

A control unit responsible for controlling the entirety of this image forming apparatus starts rotation of the photoconductive member 1, the intermediate transfer belt 51, the charging roller 2, the developing sleeve 41, the primary transfer roller 53, the secondary transfer rollers 56 and 57, and a fixing roller of the fixing unit 7 upon receiving an instruction to perform image forming on the recording material P. A high-voltage power supply (not shown) is connected to the charging roller 2 and a high-voltage that overlaps a voltage of a sinusoidal wave on a direct current voltage is applied from this high-voltage power supply. With this, the surface of the photoconductive member 1 contacting the charging roller 2 is charged uniformly. Next, when this charged surface of the photoconductive member 1 reaches a position for irradiating a laser beam from the exposure unit 3, exposure in accordance with an image signal is performed and an electrostatic latent image in accordance with the image signal is formed on the photoconductive member 1. Then, a high-voltage that overlaps a rectangle pulse waveform voltage on a direct current voltage is applied from a high-voltage power supply (not shown) to the developing sleeve 41 of the developing unit 4. With this, a negatively-charged toner is absorbed for an electrostatic latent image with a positive electric potential by the developing sleeve 41 (positive potential by the developing sleeve; negative with respect to GND), makes the electrostatic latent image a visible image (toner image), and the toner image moves in a direction of the primary transfer roller 53 in accompaniment of rotations of the photoconductive member 1. In this way, the toner images on the 4 photoconductive members 1 are transferred on the intermediate transfer belt 51 by the each corresponding primary transfer roller 53 overlappingly, and furthermore are transferred to the recording material P by the secondary transfer rollers 56 and 57. Note, a direct current high-voltage for transferring the toner image is applied from the not shown high-voltage power supply to the primary transfer roller 53 and the secondary transfer rollers 56 and 57. Remaining transfer toner remaining on the photoconductive member 1 is scraped off and recovered by the cleaner 6. Also, non-transferred toner remaining on the intermediate transfer belt 51 is scraped off and recovered by a cleaner 55. A color image is formed on the recording material P by the toner image, which is transferred to the recording material P, being fixed on the transfer material P by pressure and temperature by the fixing unit 7.

Figure 2:
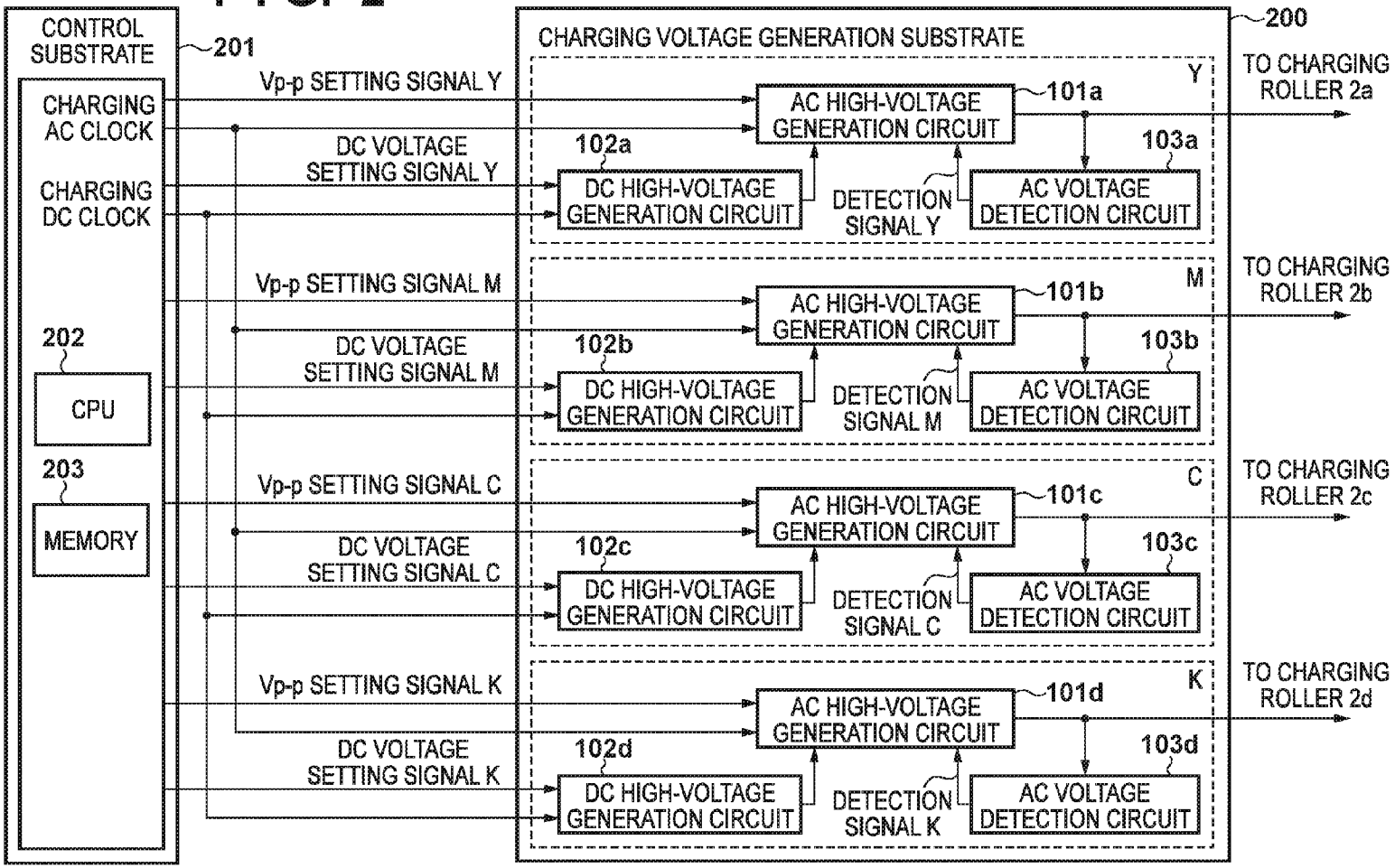
FIG. 2 is a block diagram for describing an overview configuration of a control substrate and a charging voltage substrate for generating a charging voltage supplied to a charging roller in the color image forming apparatus according to the first embodiment.

FIG. 2 is a block diagram for describing an overview configuration of a control substrate 201 and a charging voltage generation substrate 200 for generating a charging voltage supplied to the charging roller 2 in the color image forming apparatus according to the first embodiment.

The control substrate 201 includes a CPU 202 responsible for controlling the entirety of this color image forming apparatus and a memory 203 for storing programs. The control substrate 201 outputs, to AC high-voltage generation circuits 101 of the charging voltage generation substrate 200, Vp−p setting signals Y, M, C and K for setting a Vp−p which is a (peak-to-peak) voltage of AC high-voltage to the charging roller 2 corresponding to each color, and a charging AC clock for determining a frequency of an AC high-voltage waveform. Also, the control substrate 201 outputs, to DC high-voltage generation circuits 102 of the charging voltage generation substrate 200, DC voltage setting signals Y, M, C and K for setting a voltage value of a DC high-voltage for each color, and a charging DC clock for driving transformers of the DC high-voltage generation circuits 102.

The charging voltage generation substrate 200 comprises AC high-voltage generation circuits 101*a* to 101*d*, DC high-voltage generation circuits 102*a* to 102*d*, and AC voltage detection circuits 103*a* to 103*d*. The AC high-voltage generation circuits 101*a* to 101*d* and the DC high-voltage generation circuits 102*a* to 102*d* operate based on signals from the control substrate 201 and overlap, and output, an AC voltage and a DC voltage generated by each circuit. Also, the AC voltage detection circuits 103*a* to 103*d* detect output voltages of the AC high-voltage generation circuits 101*a* to 101*d* and supply detection signals Y to K indicating its detection results to each corresponding AC high-voltage generation circuit 101, respectively. Note, a to d added after numerals the AC high-voltage generation circuits 101*a* to 101*d*, the DC high-voltage generation circuits 102*a* to 102*d*, the AC voltage detection circuits 103*a* to 103*d* correspond to each of yellow, magenta, cyan, and black, similarly to in FIG. 1. Here, respective configurations of the AC high-voltage generation circuit 101, the DC high-voltage generation circuit 102 and the AC voltage detection circuit 103 corresponding to each color are the same for all of the colors. Accordingly, the following explanation is given for only circuits for yellow from the four colors, and an explanation of operation of the circuits for the other colors is omitted.

Next, explanation is given for an operation of each circuit block of circuits for yellow.

The AC high-voltage generation circuit 101*a* outputs a sinusoidal wave AC high-voltage with an amplitude set by the Vp−p setting signal Y in accordance with the frequency of the charging AC clock. The DC high-voltage generation circuit 102*a* drives a primary side of a transformer (not shown) arranged for the AC high-voltage generation circuit 101*a* using the charging DC clock, generates and outputs a direct current high-voltage set by the DC voltage setting signal Y. The AC voltage detection circuit 103*a* detects the Vp−p of an AC voltage outputted from the AC high-voltage generation circuit 101*a*, and outputs the detection signal Y corresponding to the Vp−p to the AC high-voltage generation circuit 101*a*. With this, the AC high-voltage generation circuit 101*a* performs feedback control so that the Vp−p setting signal matches with a voltage of an inputted detection signal Y. In other words, the output of the AC voltage is controlled to be lower if the voltage of the detection signal Y is higher than the voltage of the Vp−p setting signal Y, and the output of the AC voltage is controlled to be higher if the voltage of the detection signal Y is lower than the voltage of the Vp−p setting signal Y. In this way, a voltage which overlaps an alternating voltage generated by the AC high-voltage generation circuit 101*a* on a direct current voltage generated by the DC high-voltage generation circuit 102*a* is outputted to the charging roller 2*a*.

Figure 3:
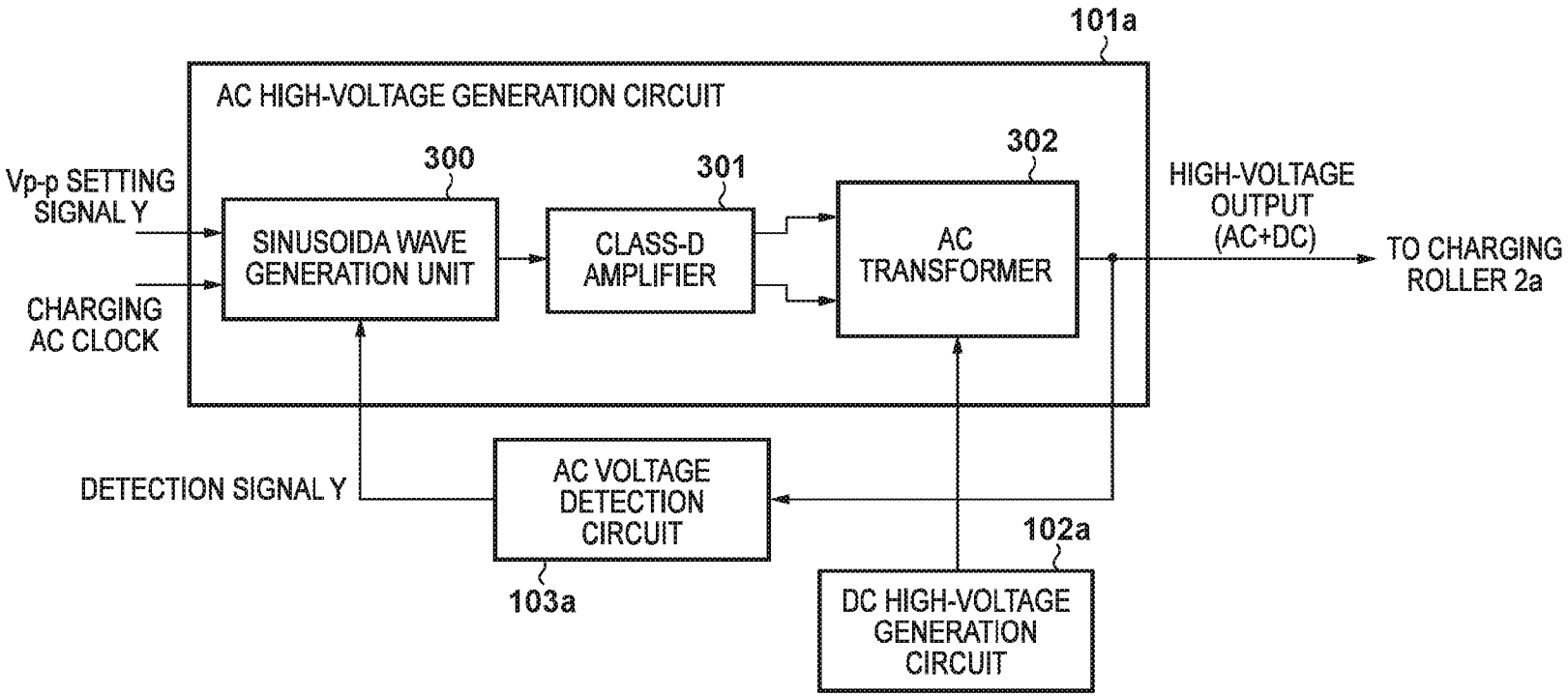
FIG. 3 is a block diagram for explaining a configuration of an AC high-voltage generation circuit according to the first embodiment.

FIG. 3 is a block diagram for explaining a configuration of the AC high-voltage generation circuit 101*a* according to the first embodiment.

The AC high-voltage generation circuit 101*a* comprises a sinusoidal wave generation unit 300, a class-D amplifier 301, and an AC transformer 302, and an output signal of the sinusoidal wave generation unit 300 is inputted to the class-D amplifier 301, and outputs of the class-D amplifier 301 are converted to a high-voltage by the AC transformer 302 and outputted. The sinusoidal wave generation unit 300, the class-D amplifier 301 and the AC transformer 302 configure a voltage generation circuit.

Below, explanation is given for an operation of each unit of the AC high-voltage generation circuit 101*a*.

The Vp−p setting signal Y, the charging AC clock, and the detection signal Y are respectively inputted to the sinusoidal wave generation unit 300, and a sinusoidal wave signal is outputted. The sinusoidal wave signal is of the frequency of the charging AC clock, and the feedback control is performed so that for its amplitude, the voltage of the detection signal Y and the Vp−p setting signal Y match. The sinusoidal wave signal generated by the sinusoidal wave generation unit 300 is inputted to the class-D amplifier 301 and converted to a pulse width modulation signal (PWM signal), a full bridge circuit is driven by the PWM signal, and a switching output is obtained. The switching outputs of this full bridge circuit are inputted to the primary side of the AC transformer 302, and a high-voltage is outputted from the secondary side of the AC transformer 302.

Figure 4:
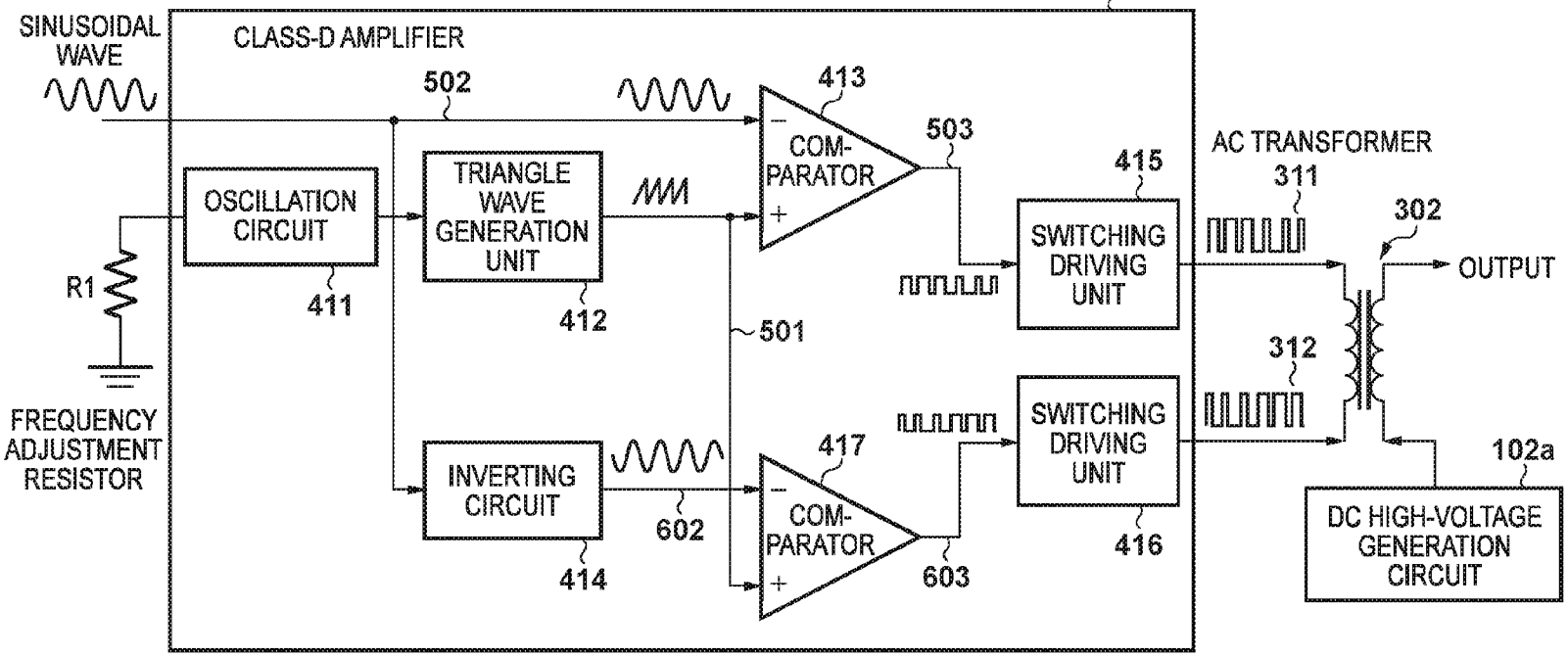
FIG. 4 is a block diagram for explaining a configuration of a class-D amplifier according to the first embodiment.

FIG. 4 is a block diagram for explaining a configuration of the class-D amplifier 301 according to the first embodiment.

The class-D amplifier 301 comprises a full bridge circuit including an oscillation circuit 411, a triangle wave generation unit 412, a comparator 413, a comparator 417, an inverting circuit 414, and switching driving units 415 and 416. A clock signal whose frequency is adjusted by a frequency adjustment resistor R1 is inputted from the oscillation circuit 411 to the triangle wave generation unit 412. A triangle wave 501 outputted from the triangle wave generation unit 412 and a sinusoidal wave signal 502 are inputted to the comparator 413, and the triangle wave 501 outputted from the triangle wave generation unit 412 and a sinusoidal wave signal 602 inverted by passing the inverting circuit 414 are inputted to the comparator 417. Each of PWM signals 503 and 603 outputted from the comparators 413 and 417 is inputted to the switching driving units 415 and 416, and the outputs of the switching driving units 415 and 416 are converted to a high-voltage by the AC transformer 302 and outputted. Next, explanation is given for an operation of each unit of the class-D amplifier 301.

The oscillation circuit 411 generates a clock signal with a reference frequency adjusted by a time constant for the frequency adjustment resistor R1 and a capacitance component C in the oscillation circuit 411, and outputs it to the triangle wave generation unit 412. The triangle wave generation unit 412 synchronizes the frequency signal from the oscillation circuit 411, generates a triangle wave with a predetermined amplitude and outputs to the comparator 413. The comparator 413 compares the triangle wave 501 generated by the triangle wave generation unit 412 with the sinusoidal wave signal 502 inputted from the sinusoidal wave generation unit 300 as illustrated in FIG. 5, and generates and outputs the PWM signal 503.

Figure 5:
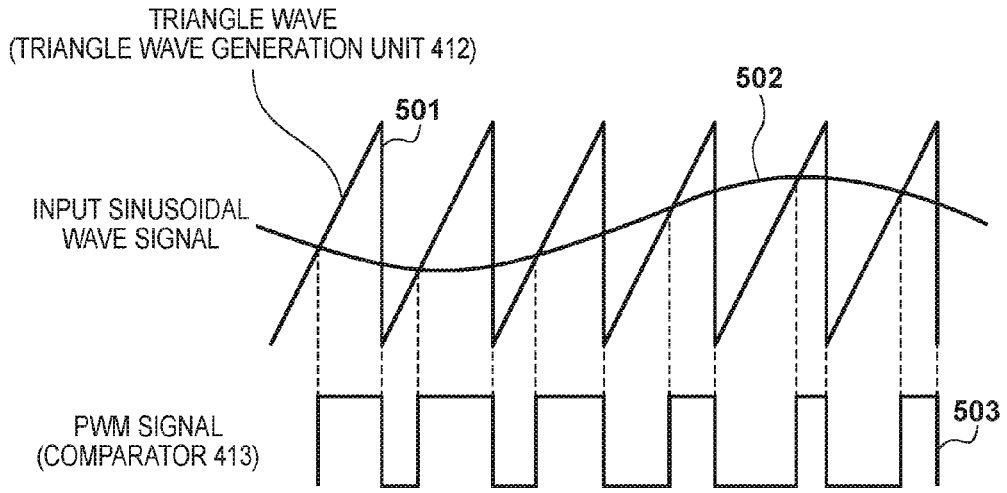
FIG. 5 is a diagram for explaining a relationship between an output signal (a PWM signal) and input signals of a comparator 413 according to the first embodiment.

FIG. 5 is a diagram for explaining a relationship between an output signal (a PWM signal) and input signals of the comparator 413 according to the first embodiment.

Here, the PWM signal 503 which becomes a high level in an interval in which the amplitude of the triangle wave 501 is larger than the amplitude of the sinusoidal wave signal 502 is obtained.

Figure 6:
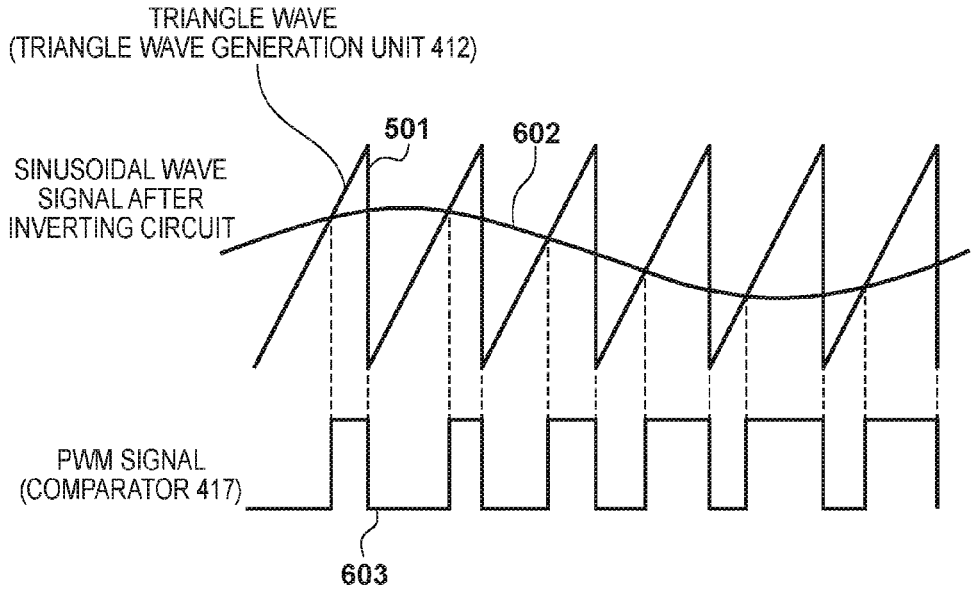
FIG. 6 is a diagram for explaining a relationship between an output signal (a PWM signal) and input signals of a comparator 417 according to the first embodiment.

Meanwhile, the comparator 417, as illustrated in FIG. 6, compares the triangle wave 501 generated by the triangle wave generation unit 412 with the sinusoidal wave signal 602 inverted through the inverting circuit 414, and generates and outputs the PWM signal 603.

FIG. 6 is a diagram for explaining a relationship between an output signal (a PWM signal) and input signals of the comparator 417 according to the first embodiment.

Here, the PWM signal 603 which becomes a high level in an interval in which the amplitude of the triangle wave 501 is larger than the amplitude of the sinusoidal wave signal 602 is obtained.

Each of the PWM signals is inputted to the full bridge circuit configured by the switching driving unit 415 and the switching driving unit 416. The switching driving unit 415 outputs a drive voltage to a primary side terminal 311 of the AC transformer 302, and the switching driving unit 416 outputs a drive voltage to a primary side terminal 312 of the AC transformer 302. An electric current flows between the primary side terminals 311 and 312 of the AC transformer 302 by electric potential difference of the output voltages of the switching driving units 415 and 416, and an AC high-voltage is generated on the secondary side of the AC transformer 302. In this way, the AC high-voltage for the charging roller generated by the switching circuit is supplied for a capacitive load C including the charging roller 2*a* and the photoconductive element 1*a*.

Figure 7:
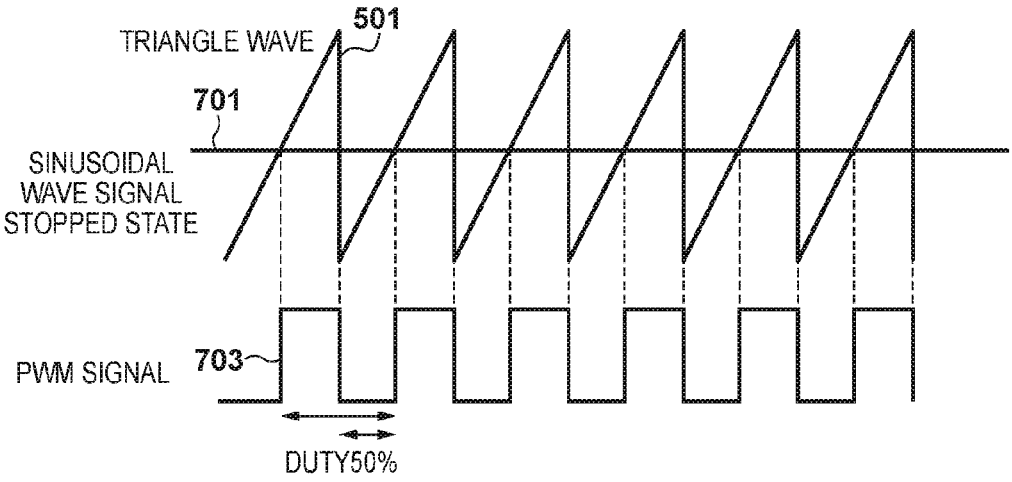
FIG. 7 depicts a view for explaining a PWM signal when a sinusoidal wave signal from a sinusoidal wave generation unit is in a stopped state in the first embodiment.

FIG. 7 depicts a view for explaining a PWM signal when a sinusoidal wave signal from the sinusoidal wave generation unit 300 is in a stopped state in the first embodiment.

When a sinusoidal wave signal 701 from the sinusoidal wave generation unit 300 is in a stopped state, the frequency of a PWM signal 703 generated by the comparator 413 is fixed, and the duty is also fixed to 50%.

Next, explanation is given for the frequency of the PWM signal outputted by the comparator 417.

The frequency of the PWM signal outputted by the comparator 417 is determined by the time constant for the frequency adjustment resistor R1 connected to the oscillation circuit 411 and a condenser C (not shown) in the oscillation circuit 411, and the frequency of the PWM signal is set so that an AC high-voltage waveform for charging is not broken. For example, in a case where the frequency of the AC high-voltage waveform for charging is 1 kHz, a sufficiently higher frequency of 500 kHz is set so that the waveform is not broken. Regarding a target for this sufficiently high frequency, it is assumed that a low-pass filter is configured by capacitive loads of both the charging roller 2*a* and the photosensitive member 1*a* and a leakage inductance component of the secondary side of the AC transformer 302. The target is a range where this low-pass filter allows a frequency component of the AC high-voltage waveform for charging of the PWM signal to pass and does not allow a high-frequency component to pass.

Next, explanation is given for a configuration of the full bridge circuit including the switching driving units 415 and 416.

Figure 8:
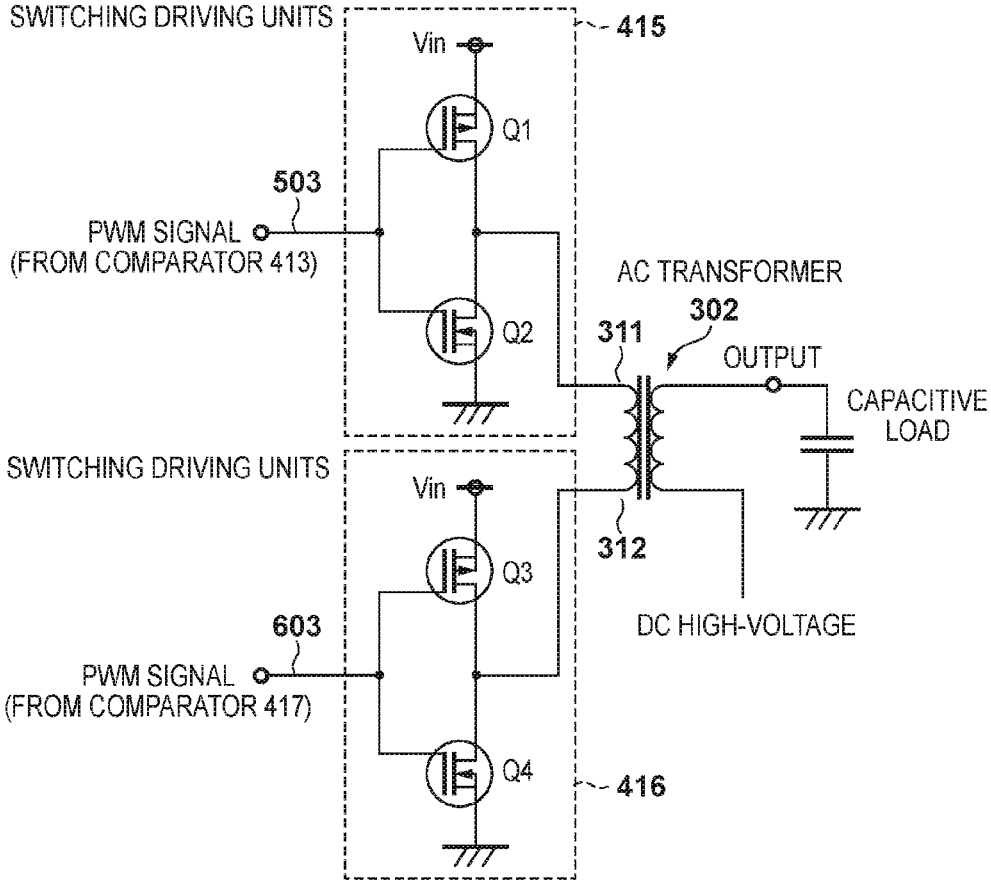
FIG. 8 is a circuit diagram of switching driving units 415 and 416 according to an embodiment.

FIG. 8 is a circuit diagram of the switching driving units 415 and 416 according to the embodiment.

The switching driving unit 415 comprises a transistor Q1 (a p-type MOS-FET) and a transistor Q2 (an n-type MOS-FET), and the switching driving unit 416 comprises a transistor Q3 (a p-type MOS-FET) and a transistor Q4 (an n-type MOS-FET). To gate terminals of the transistors Q1 and Q2 of the switching driving unit 415, the PWM signal 503 output from the comparator 413 is input. To gate terminals of the transistors Q3 and Q4 of the switching driving unit 416, the PWM signal 603 output from the comparator 417 is input. Also, drain terminals of the transistors Q1 and Q2 are connected to each other, and drain terminal of the transistors Q3 and Q4 are connected to each other. Also, a power-supply voltage Vin is connected to source terminals of the transistors Q1 and Q3, and the source terminals of the transistors Q2 and Q4 are connected to ground. By these 4 transistors Q1 to Q4, a full bridge circuit that uses 2 half bridge circuits is configured.

Next, explanation is given for operation of this circuit.

When the PWM signals 503 and 603 for gate control that are supplied to the switching driving units 415 and 416 are at a low level, the transistors Q1 and Q3 both become on, and the transistors Q2 and Q4 become off. Also, when the PWM signals 503 and 603 are at a high level, the transistors Q1 and Q3 become off and the transistors Q2 and Q4 become on. Here, for the output of the switching driving units 415 and 416, as illustrated in FIG. 5 and FIG. 6, the duty differs therebetween. For this reason, an electric current flows to the primary side of the AC transformer 302 due to an electric potential difference generated in the terminals 311 and 312 of the primary side of the AC transformer 302, and thereby a high-voltage is generated on the secondary side of the AC transformer 302, and a capacitive load for a load consisting of the charging roller 2*a* and the photosensitive drum 1*a* is output.

Here, explanation is given for a difference when 1500 [Vp−p] is output and when 0 [V] is output for the drive waveform that the full bridge circuit in the class-D amplifier 301 outputs.

Figure 9:
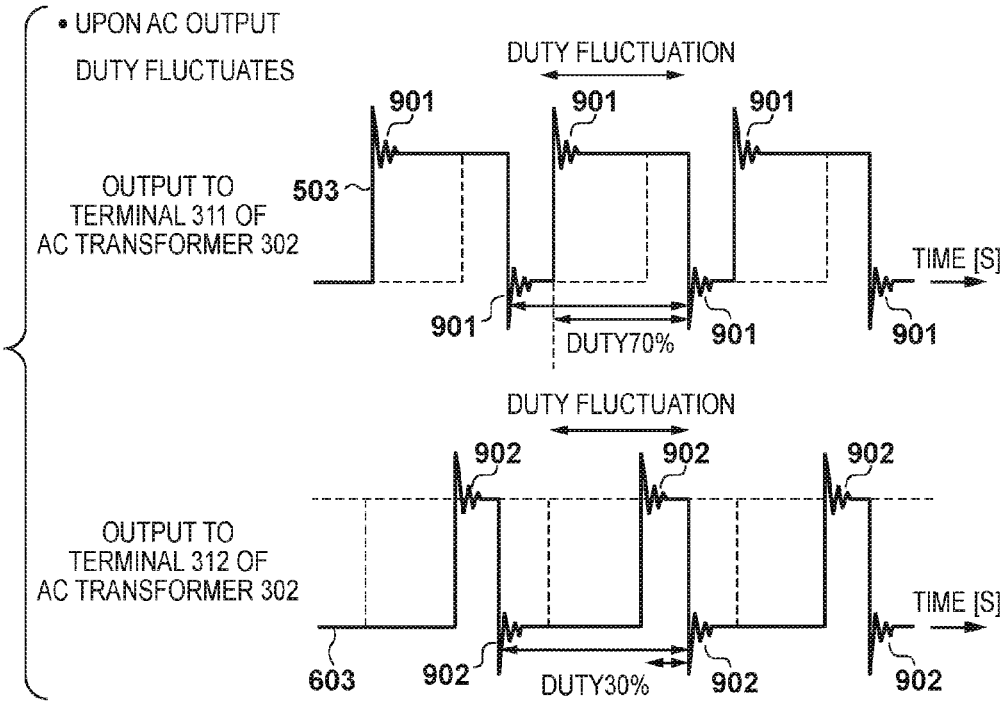
FIG. 9 depicts a view for illustrating an example of drive waveforms outputted to primary side terminals of an AC transformer when the AC high-voltage generation circuit according to the first embodiment outputs 1500 [Vp−p].

FIG. 9 depicts a view for illustrating an example of waveforms of the PWM signals output to the terminals 311 and 312 of the primary side of the AC transformer 302 when the AC high-voltage generation circuit 101*a* according to the first embodiment outputs 1500 [Vp−p].

In the waveforms of the 2 PWM signals 503 and 603, as illustrated in FIG. 9, noise components 901 and 902 occur at a leading edge and a trailing edge of rectangular waves. However, for the 2 PWM signals 503 and 603 inputted to the terminals 311 and 312 of the primary side of the AC transformer 302 here, the duty continuously fluctuates as explained in previously described FIG. 5 and FIG. 6. For this reason, the frequencies and the duties of the 2 PWM signals 503 and 603 are not fixed. Accordingly, the ratio at which the noise components 901 and 902 occur that the same time becomes very small.

Figure 10:
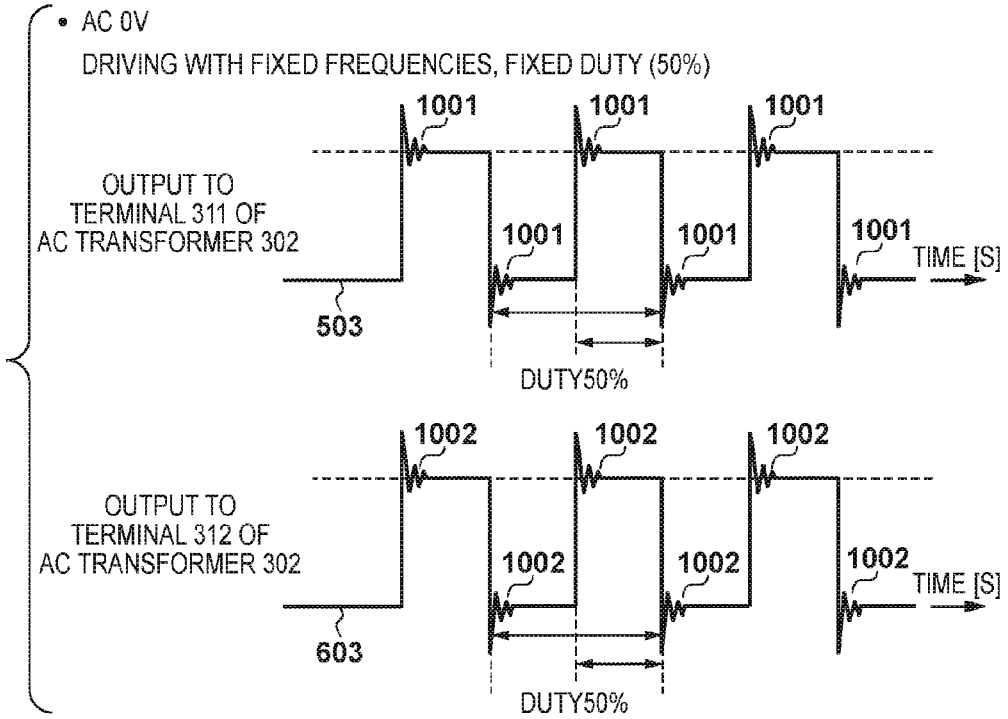
FIG. 10 depicts a view for illustrating an example of PWM signal waveforms outputted to primary side terminals of the AC transformer when the AC high-voltage generation circuit according to the first embodiment is in a standby state (0 [V]).

FIG. 10 depicts a view for illustrating an example of PWM signal waveforms outputted to primary side terminals 311 and 312 of the AC transformer 302 when the AC high-voltage generation circuit 101*a* according to the first embodiment is in a standby state (0[V]).

Because for these 2 PWM signal waveforms, as is illustrated by FIG. 7, both the frequencies and the duties (50%) are fixed, compared to the situation of FIG. 9, the noise 1001 and 1002 occurs at the same time. Thereby, the noise is amplified more.

The color image forming apparatus according to the first embodiment comprises 4 image forming stations of yellow, magenta, cyan, and black, and full bridge circuits in the class-D amplifiers in the image forming stations of respective colors are caused to operate simultaneously. For this reason, when the switching noises that occur at the image forming stations of respective colors are overlapped, the noise level further worsens.

Figure 11:
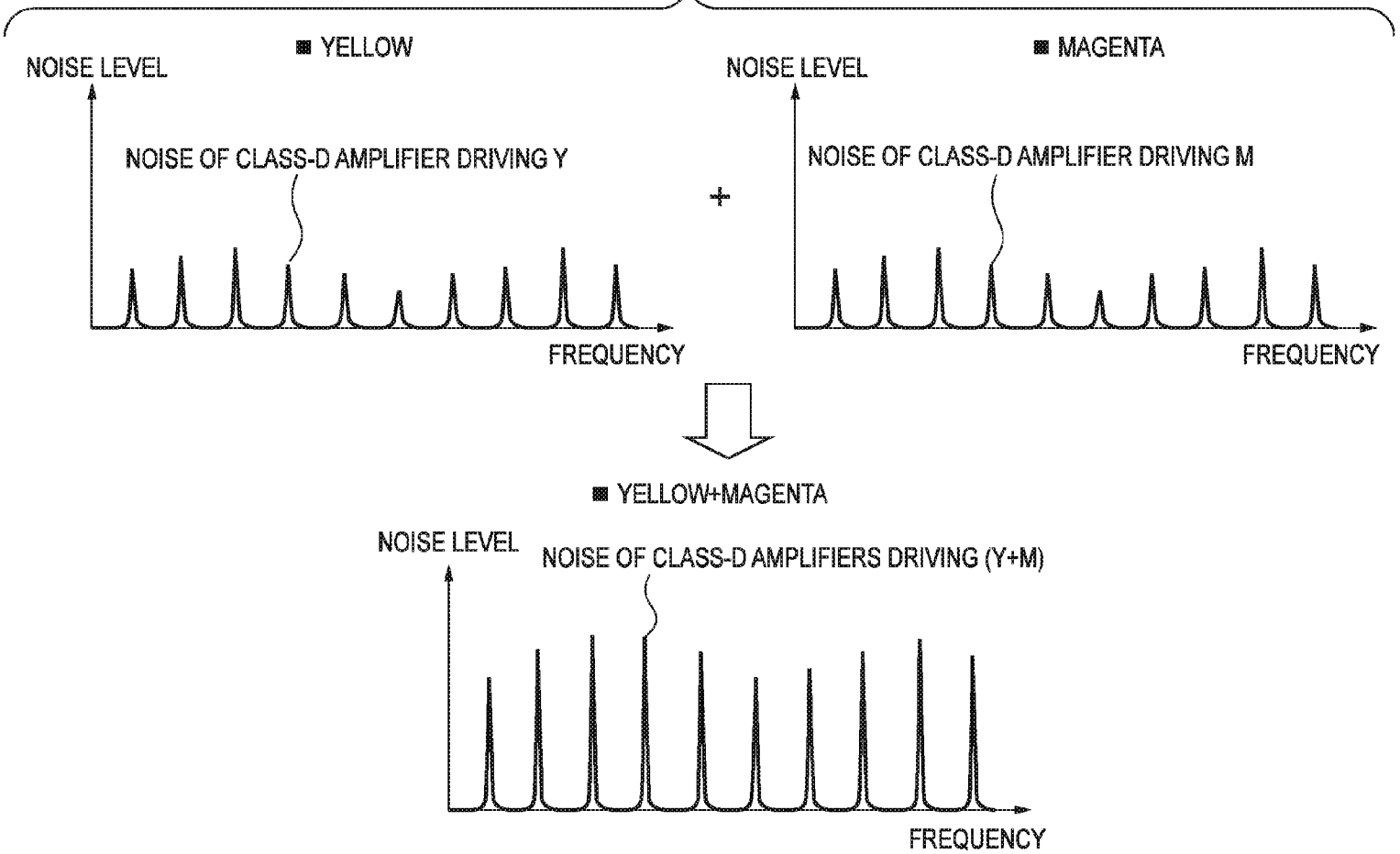
FIG. 11 depicts a view for illustrating an example of generated noise spectrums in a case where class-D amplifiers are driven at the same frequency in two image forming stations of yellow and magenta in a conventional color image forming apparatus.

FIG. 11 depicts a view for illustrating an example of generated noise spectrums in a case where respective class-D amplifiers are driven at the same frequency in two image forming stations of yellow and magenta in a conventional color image forming apparatus.

Because noise peaks occur at the same frequency (timing) if the respective class-D amplifiers of the yellow and magenta image forming stations are each driven at the at the same frequency, the noises that occur at the image forming stations of these two colors are overlapped, and the noise peaks become large.

Figure 12:
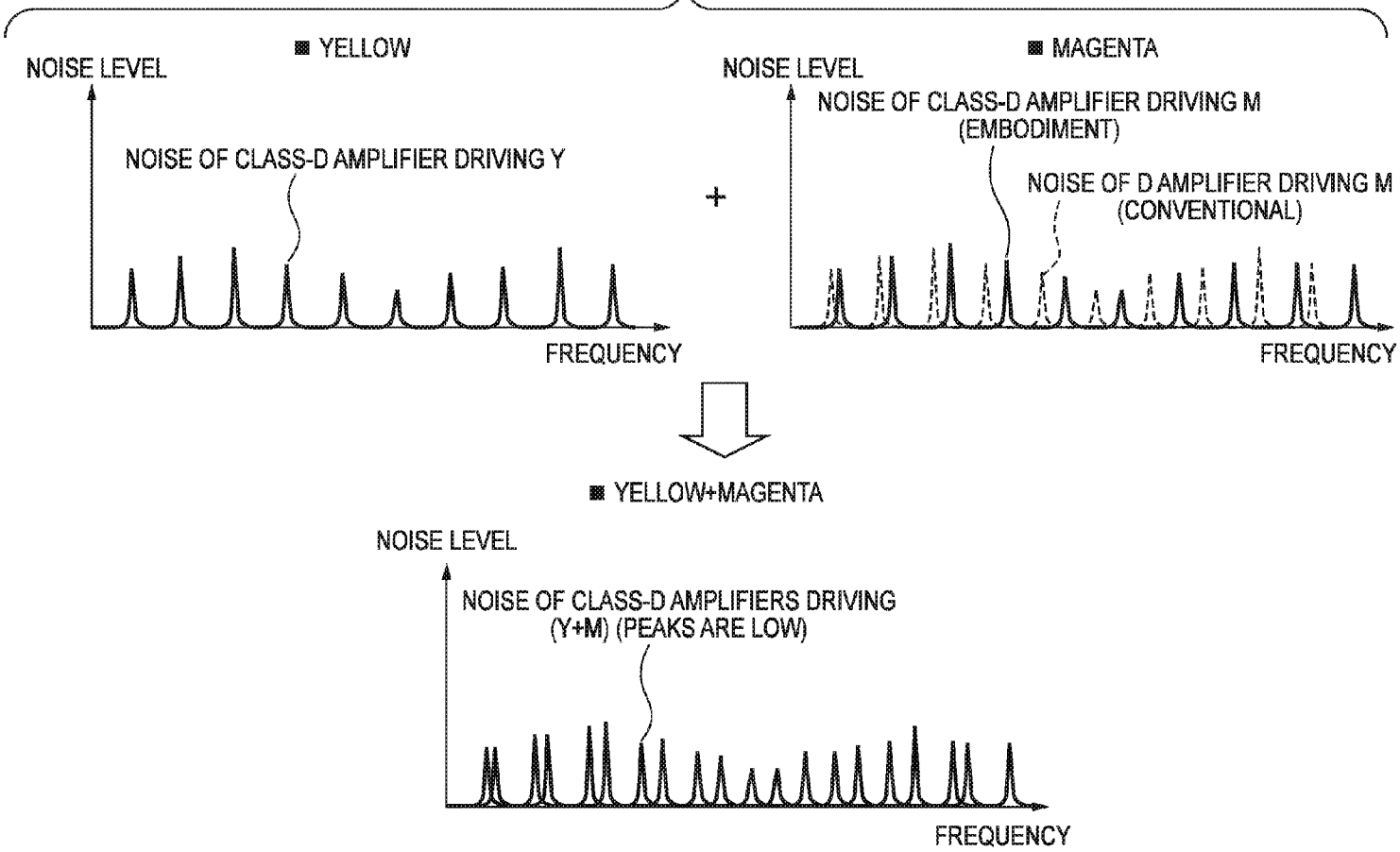
FIG. 12 depicts a view for illustrating an example of generated noise spectrums in a case where two class-D amplifiers of yellow and magenta are driven at differing frequencies in the color image forming apparatus according to the first embodiment.

FIG. 12 depicts a view for illustrating an example of generated noise spectrums in a case where 2 class-D amplifiers of yellow and magenta are driven at differing frequencies from each other in the color image forming apparatus according to the first embodiment.

Because noise peaks do not occur at the same time when the class-D amplifiers of the yellow and magenta image forming stations are each driven at different frequencies from each other, the noise that occurs at the image forming stations of these two colors is not overlapped. For this reason, compared to when the PWM signals of the class-D amplifiers of the image forming stations of the two colors are driven at the same frequency as in FIG. 11, it is possible to suppress the noise peaks to be lower.

Figure 13:
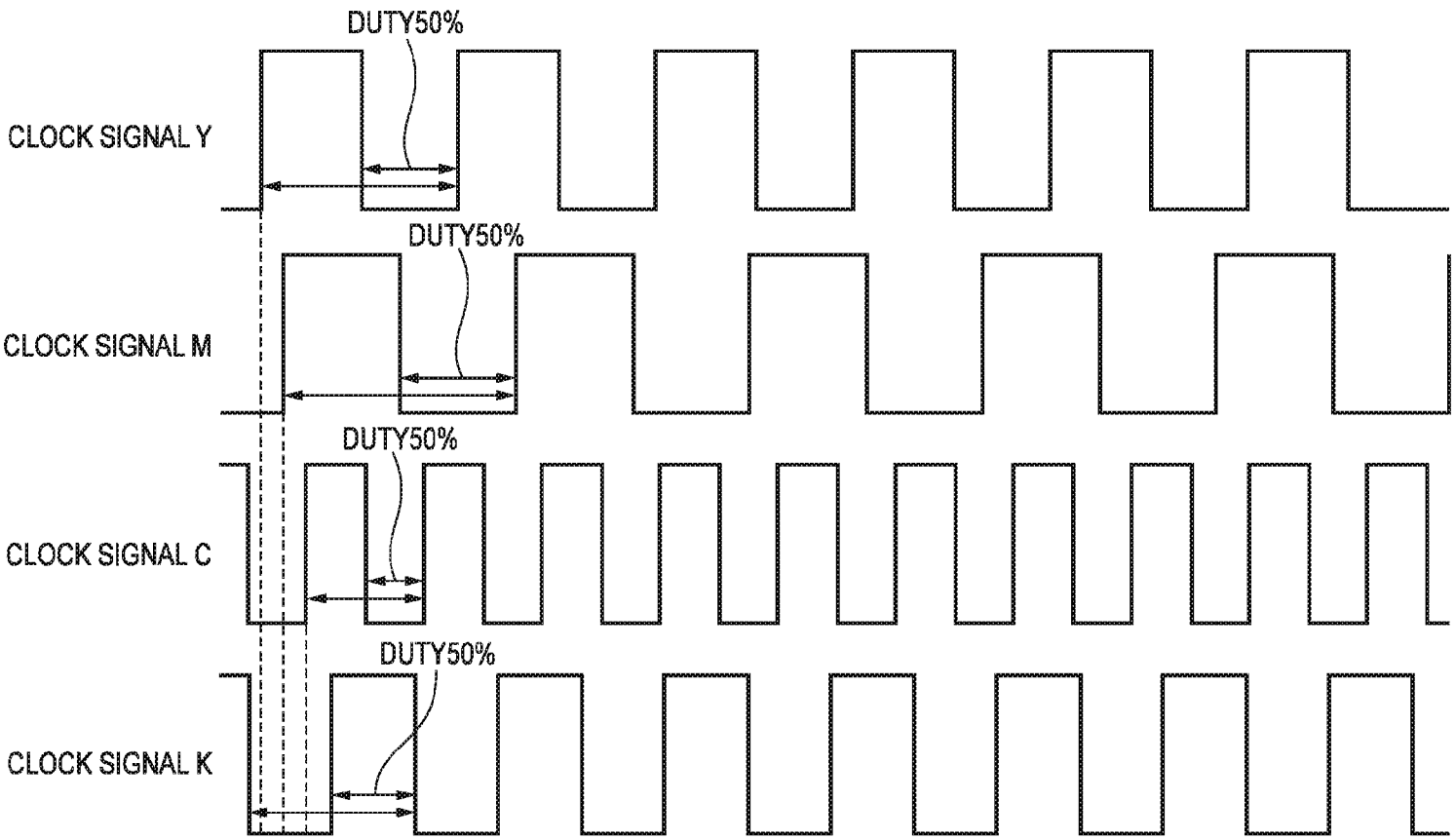
FIG. 13 depicts a view for illustrating an example of clock signals outputted by oscillation circuits of high-voltage circuits of yellow, magenta, cyan, and black in the color image forming apparatus according to the first embodiment.

FIG. 13 depicts a view for illustrating an example of clock signals outputted by the oscillation circuit 411 of 4 high-voltage circuits of yellow, magenta, cyan, and black in the color image forming apparatus according to the first embodiment. Each of the clock signals Y to K illustrates a clock signal that the oscillation circuit 411 of the class-D amplifiers for yellow, magenta, cyan and black output.

In the first embodiment, because the frequencies of the clock signals that the oscillation circuit 411 corresponding to each of the colors outputs differ from each other, the frequencies of the PWM signal of the class-D amplifier 301 corresponding to respective colors differ from each other. Accordingly, because signals of noise components do not occur at the same period, it is possible to suppress the peaks of radiation noise to be lower compared to when driving the class-D amplifiers conventionally as illustrated by FIG. 11.

Here, the frequencies of the PWM signals are determined by the value of the frequency adjustment resistor R1 connected to the oscillation circuit 411, and in the first embodiment, the values of the frequency adjustment resistor R1 corresponding to respective colors are different from each other. Also, as the value of the frequency adjustment resistor R1, a resistance of a value for which individual variation, temperature variation, and variation of internal capacitance of the oscillation circuit 411 corresponding to respective colors are considered is selected, and even if error occurs, the frequencies of respective colors do not become the same. For example, if the value of the frequency adjustment resistor R1 connected to the class-D amplifier 301 driving the AC transformer 302 for yellow is assumed to be 30 kΩ±1%, the frequency adjustment resistor R1 for magenta is set considering variation of the internal capacitance within the oscillation circuit 411. Here, for example, a value for the frequency adjustment resistor R1 is connected to the class-D amplifier 301 for magenta so not to enter a 30 kΩ±6%, in other words a range from 28.2 kΩ to 31.8 kΩ.

Similarly, the values of the frequency adjustment resistor R1 connected to the class-D amplifier for cyan and black are selected so not to become the same as the value of the frequency adjustment resistor R1 connected to the class-D amplifier for the other colors in accordance with error, variation, or the like. Also, for the frequencies of the PWM signals for respective colors, the frequency adjustment resistor R1 is selected so that the frequencies are of a level at which the AC high-voltage waveform for charging that the AC transformer 302 outputs is not broken. The frequencies of the PWM signal of a level that the AC high-voltage waveform for charging is not broken differ depending on a target AC high-voltage waveform frequency for charging, a distance of the charging roller and the photosensitive member, a variation of load, an environment, and variation of the resistors R1*a* to R1*d*, or the like. The frequencies of the PWM signal in the color image forming apparatus according to the first embodiment are assumed to be approximately 300 to 600 kHz.

By the first embodiment, as explained above, by causing the frequencies of the PWM signals that the class-D amplifiers for respective colors output to be different from each other, the signals of noise components generated in image forming of respective colors occur at mutually differing timings. Thereby, compared to a case in which the frequencies of the PWM signals that the class-D amplifiers for respective colors output are the same, it is possible to suppress noise peaks to be lower.

In the first embodiment, explanation is given for a class-D amplifier by a full bridge circuit, but it is possible to achieve a similar effect even in the case of driving the transformers by a half-bridge.

Also, in the first embodiment, the class-D amplifiers are used for respective colors yellow, magenta, cyan and black. However, the present invention is not limited to this, and for example, AC transformers of two colors may be simultaneously driven by 1 class-D amplifier. In this way, even if a configuration differs to the first embodiment, if the number of class-D amplifiers used is plural, it is possible to achieve a similar effect by employing a similar configuration.

[Second Embodiment]

In the previously described first embodiment, explanation is given for an example of a high-voltage circuit for charging of an electrophotographic image forming apparatus, but in the second embodiment explanation is given an example using a high-voltage circuit that generates a developing voltage. Note that because the basic configuration of the image forming apparatus according to a second embodiment is the same as in the first embodiment, detailed explanation is given for portions that differ to the first embodiment.

Figure 14:
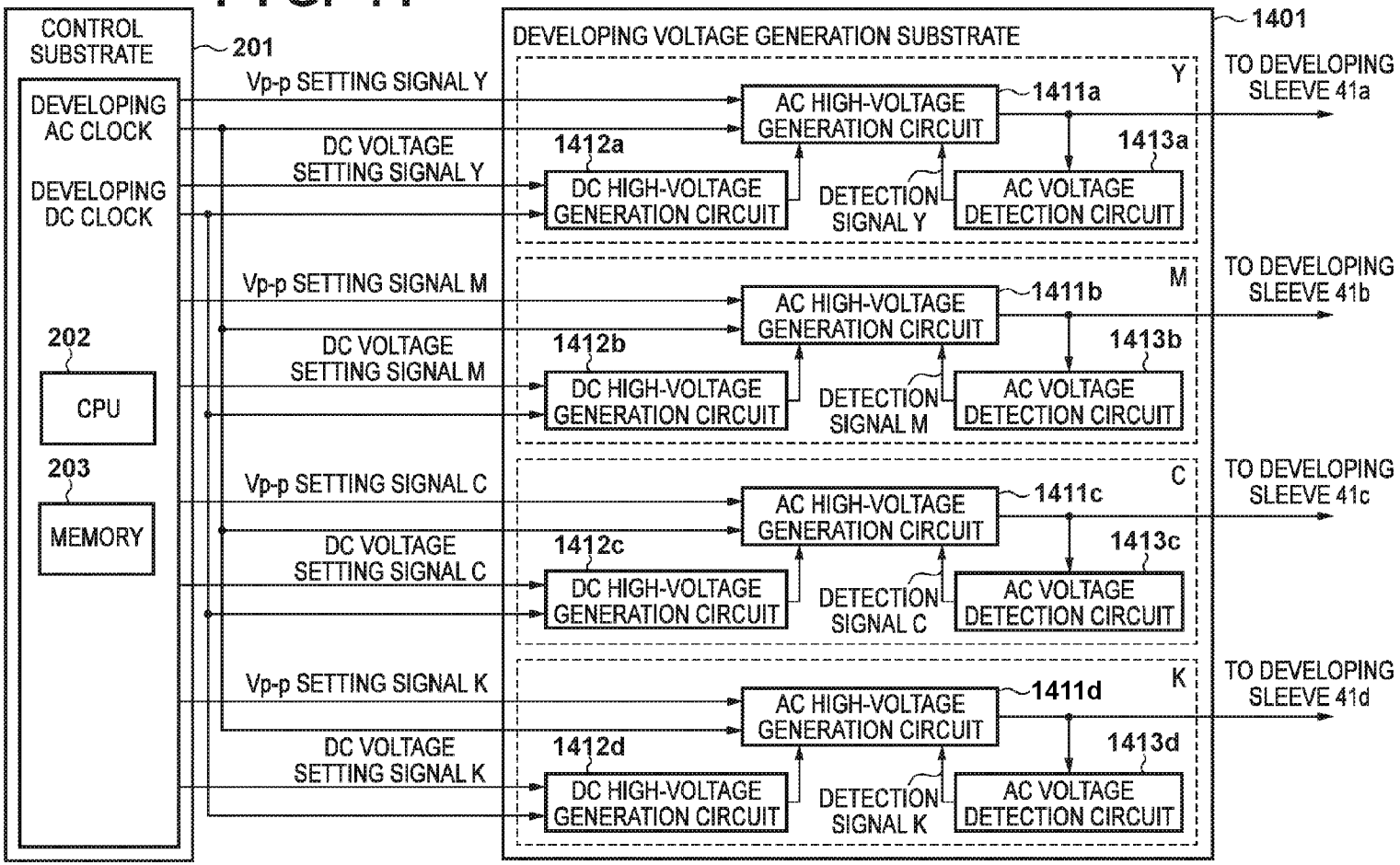
FIG. 14 is a block diagram for illustrating an overview configuration of a developing voltage substrate and the control substrate of the color image forming apparatus according to a second embodiment of the present invention.

FIG. 14 is a block diagram for describing an overview configuration of a developing voltage generation substrate 1401 and the control substrate 201 of the color image forming apparatus according to a second embodiment of the present invention.

The control substrate 201 includes a CPU 202 responsible for controlling the entirety of this color image forming apparatus and a memory 203 for storing programs, similarly to in the case of the first embodiment. Also, the control substrate 201 outputs to the developing voltage generation substrate 1401 Vp−p setting signals Y, M, C and K that set the Vp−p of the AC high-voltage, and DC voltage setting signals Y, M, C and K that set the voltage value of the DC high-voltage of the developing voltage generation substrate 1401. Furthermore, a developing AC clock that determines a frequency of the AC high-voltage waveform for developing and a developing DC clock that drives the transformer of the DC high-voltage generation circuits are output.

The developing voltage generation substrate 1401 comprises AC high-voltage generation circuits 1411*a* to 1411*d*, DC high-voltage generation circuits 1412*a* to 1412*d*, and AC voltage detection circuits 1413*a* to 1413*d*. Also, based on signals from the control substrate 201, the AC high-voltage generation circuits 1411*a* to 1411*d* and the DC high-voltage generation circuits 1412*a* to 1412*d* operate, and voltages generated by each circuit are overlapped and output. Also, the AC voltage detection circuits 1413*a* to 1413*d* each detect an output voltage of the AC high-voltage generation circuits 1411*a* to 1411*d* respectively, and the detection signals are respectively input into each corresponding AC high-voltage generation circuit. Note, a to d added after numerals the AC high-voltage generation circuits 1411*a* to 1411*d*, the DC high-voltage generation circuits 1412*a* to 1412*d*, the AC voltage detection circuits 1413*a* to 1413*d* correspond to each of yellow, magenta, cyan, and black image forming units. Here, for the AC high-voltage generation circuit, the DC high-voltage generation circuit, and the AC voltage detection circuit corresponding to respective colors, the internal configurations are common irrespective of the color, and in explanation hereinafter, explanation is given for only circuits corresponding to yellow from the four colors.

Firstly, explanation is given for operation of the AC high-voltage generation circuit 1411*a*, the DC high-voltage generation circuit 1412*a*, and the AC voltage detection circuit 1413*a*.

The AC high-voltage generation circuit 1411*a* outputs at the frequency of the developing AC clock an AC high-voltage with an amplitude set by the Vp−p setting signal Y. The DC high-voltage generation circuit 1412*a* drives a primary side of a transformer (not shown) arranged for the AC high-voltage generation circuit 1411*a* by the developing DC clock, and generates and outputs a DC high-voltage of a voltage set by the DC voltage setting signal Y. The AC voltage detection circuit 1413*a* detects the Vp−p of an AC high-voltage outputted from the AC high-voltage generation circuit 1411*a*, and outputs the detection signal Y corresponding to the Vp−p to the AC high-voltage generation circuit 1411*a*. In the AC high-voltage generation circuit 1411*a*, feedback control is performed so that the Vp−p setting signal Y matches with a voltage of an inputted detection signal Y. In other words, the output of the AC high-voltage is controlled to be lower if the voltage of the detection signal Y is higher than the voltage of the Vp−p setting signal Y, and the output of the AC high-voltage is controlled to be higher if the voltage of the detection signal Y is lower than the voltage of the Vp−p setting signal Y. In this way, a voltage which overlaps an alternating voltage generated by the AC high-voltage generation circuit 1411*a* on a direct current voltage generated by the DC high-voltage generation circuit 1412*a* is outputted to the developing sleeve 41*a*.

Explanation is given for an alternating voltage waveform applied to the developing sleeve 41*a*.

For an alternating voltage waveform applied to the developing sleeve 41*a*, there is a sinusoidal wave, a rectangular wave, a rectangular duty wave, a blank pulse, or the like.

Figure 15:
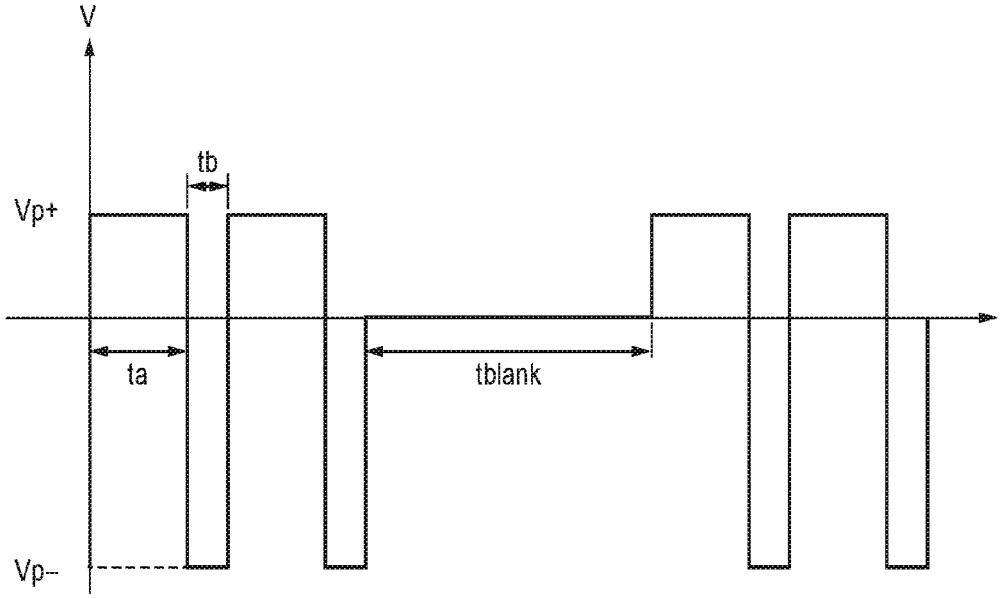
FIG. 15 depicts a view for illustrating an example of a biased duty blank pulse waveform in which intervals for outputting a positive voltage Vp+ and intervals for outputting a negative voltage Vp− are different, an absolute value of Vp+ is smaller than an absolute value of Vp−, and a blank interval is comprised in the second embodiment.

FIG. 15 depicts a view for illustrating an example of a biased duty blank pulse waveform in which, in the second embodiment, intervals for outputting a positive voltage Vp+ and intervals for outputting a negative voltage Vp− are different, an absolute value of Vp+ is smaller than an absolute value of Vp−, and a blank interval is comprised.

Here the times ta and tb are, for example, 70 μs and 30 μs, and the time of one period at which Vp+ and Vp− are output is 100 μs, i.e. a frequency is 10 kHz. Vp+ and Vp− are 450V and 1050V which is of an opposite ratio to that of the times ta and tb, and the value 1500 Vpp is used as the overall amplitude.

Figure 16:
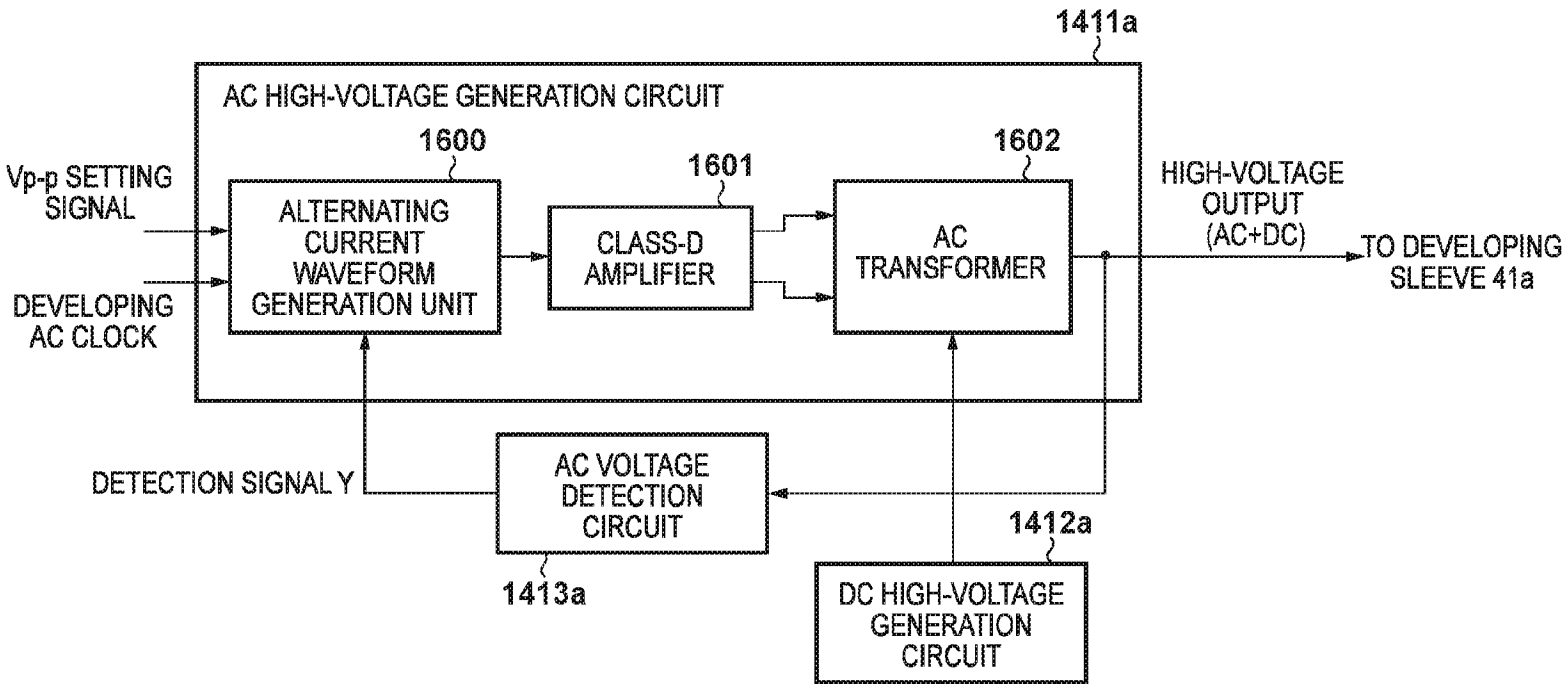
FIG. 16 is a block diagram for explaining a configuration of an AC high-voltage generation circuit according to the second embodiment.

FIG. 16 is a block diagram for explaining a configuration of the AC high-voltage generation circuit 1411*a* according to the second embodiment.

The AC high-voltage generation circuit 1411*a* comprises an alternating current waveform generation unit 1600, a class-D amplifier 1601, and an AC transformer 1602. Here, the output signal of the alternating current waveform generation unit 1600 is input to the class-D amplifier 1601, and the outputs of the class-D amplifier 1601 are converted to a high-voltage by the AC transformer 1602 and output. Explanation is given for operation of the respective circuits.

To the alternating current waveform generation unit 1600, the Vp−p setting signal and the developing AC clock output from the control substrate 201, and the detection signal Y from the AC voltage detection circuit 1413*a* are respectively inputted, and an alternating current signal is outputted. The alternating current signal is of the frequency of the developing AC clock, and feedback control is performed so that for its amplitude, the voltage of the detection signal Y and the Vp−p setting signal match. The class-D amplifier 1601 converts the alternating current signal generated by the alternating current waveform generation unit 1600 into a PWM signal, a full bridge circuit is driven by the PWM signal, and a switching output is obtained. The switching outputs of this full bridge circuit are inputted to the primary side of the AC transformer 1602, and a high-voltage is outputted from the secondary side of the AC transformer 1602.

Figure 17:
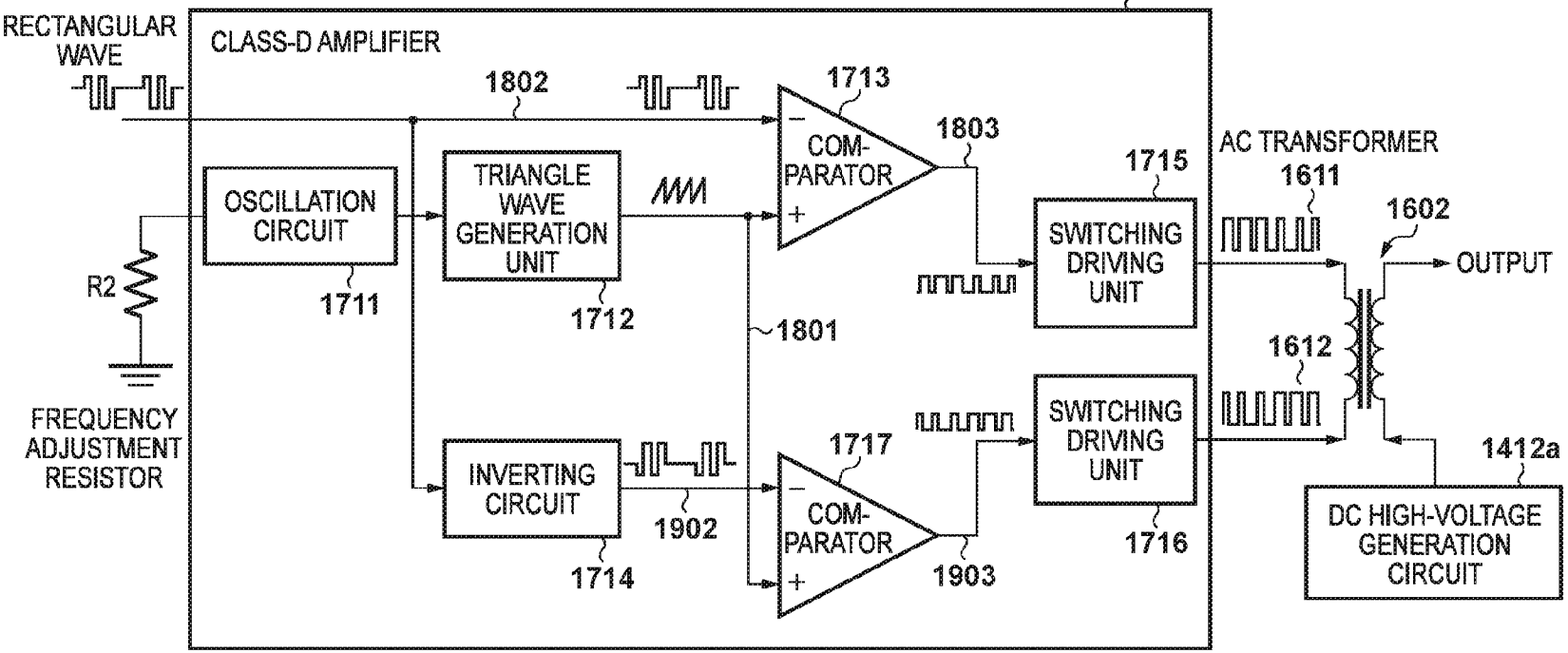
FIG. 17 is a block diagram for describing a configuration of the class-D amplifier according to the second embodiment.

FIG. 17 is a block diagram for illustrating a configuration of the class-D amplifier 1601 according to the second embodiment.

The class-D amplifier 1601 includes a full bridge circuit comprising an oscillation circuit 1711, a triangle wave generation unit 1712, comparators 1713 and 1717, an inverting circuit 1714, and switching driving units 1715 and 1716. To the triangle wave generation unit 1712, a clock signal of a frequency adjusted by a frequency adjustment resistor R2 is input from the oscillation circuit 1711, and to the comparator 1713 the triangle wave 1801 output from the triangle wave generation unit 1712 and an alternating current signal 1802 are input as is. Also, to the comparator 1717 the triangle wave 1801 output from the triangle wave generation unit 1712 and an alternating current signal 1902 inverted through the inverting circuit 1714 are input. Each of PWM signals 1803 and 1903 outputted from the comparators 1713 and 1717 is inputted to the switching driving units 1715 and 1716, and the outputs of the switching driving units 1715 and 1716 are converted to a high-voltage by the AC transformer 1602 and outputted. Next, explanation is given for an operation of each circuit block of FIG. 17.

The oscillation circuit 1711 generates a clock signal with a frequency adjusted by a time constant for the frequency adjustment resistor R2 and a condenser C in the oscillation circuit 1711, and outputs it to the triangle wave generation unit 1712. The triangle wave generation unit 1712 synchronizes the clock signal from the oscillation circuit 1711, generates a triangle wave with a predetermined amplitude and outputs to the comparator 1713.

Figure 18:
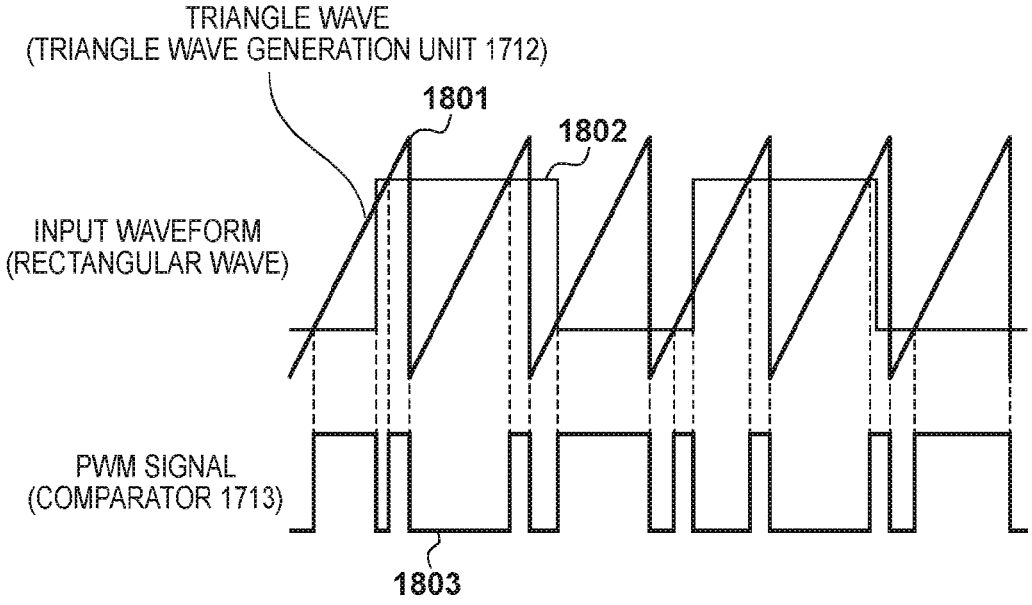
FIG. 18 depicts a view for illustrating a waveform example when a comparator 1713 according to the second embodiment compares a triangle wave generated by a triangle wave generation unit with an alternating current signal inputted from an alternating current waveform generation unit and generates a PWM signal.

FIG. 18 depicts a view for illustrating a waveform example for when the comparator 1713 according to the second embodiment compares the triangle wave 1801 generated by the triangle wave generation unit 1712 and the alternating current signal 1802 input from the alternating current waveform generation unit 1600 and generates the PWM signal 1803. Here, the PWM signal 1803 is generated such that it becomes a high level in an interval when the amplitude of the triangle wave 1801 is larger than the amplitude of the alternating current signal 1802.

Figure 19:
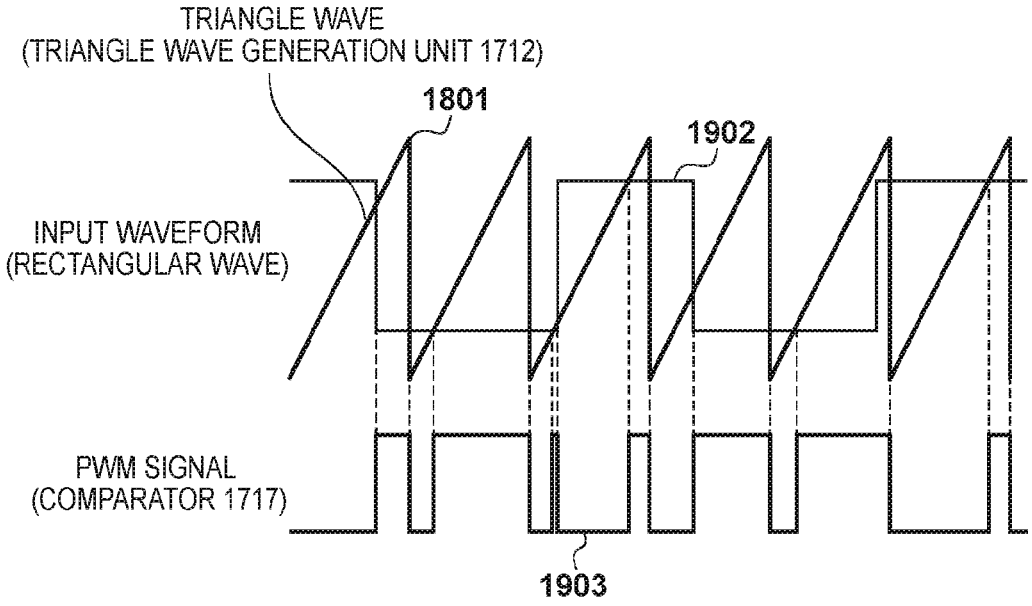
FIG. 19 depicts a view for illustrating a waveform example when a comparator 1717 according to the second embodiment compares a triangle wave generated by a triangle wave generation unit with an alternating current signal inverted through an inverting circuit, and generates a PWM signal.

FIG. 19 depicts a view for illustrating a waveform example for when the comparator 1717 according to the second embodiment compares the triangle wave 1801 generated by the triangle wave generation unit 1712 and the alternating current signal 1902 inverted through the inverting circuit 1714, and generates the PWM signal 1903. Here, the PWM signal 1903 is generated such that it becomes a high level in an interval when the amplitude of the triangle wave 1801 is larger than the amplitude of the inverted alternating current signal 1902.

Each of the PWM signals 1803 and 1903 thus output is inputted to the full bridge circuit configured by the switching driving unit 1715 and the switching driving unit 1716. The switching driving unit 1715 outputs a drive voltage to a primary side terminal 1611 of the AC transformer 1602, and the switching driving unit 1716 outputs a drive voltage to a primary side terminal 1612 of the AC transformer 1602. An electric current flows between the primary side terminals 1611-1612 of the AC transformer 1602 by electric potential difference of the output voltages of the switching driving units 1715 and 1716, and an AC high-voltage is generated on the secondary side of the AC transformer 1602. Thus generated AC high-voltage for developing is supplied to the developing sleeve 41*a*.

Note that similarly to in the case of the previously described first embodiment, as illustrated in FIG. 7, when in a state in which input from the alternating current waveform generation unit 1600 is stopped, the frequency and the duty (50%) both become fixed for the generated PWM signal in the second embodiment as well.

Next, explanation is given for the frequency of the PWM signal 1903 outputted by the comparator 1717.

The frequency of the PWM signal 1903 is determined by the time constant for the frequency adjustment resistor R2 connected to the oscillation circuit 1711 and a condenser C (not shown) in the oscillation circuit 1711, and the frequency of the PWM signal is set so that a developing AC high-voltage waveform is not broken. For example, when the frequency of the AC high-voltage waveform for developing is 1 kHz, a sufficiently higher frequency of 500 kHz is set so that the waveform is not broken. A target of this sufficiently large frequency is a range such that a low-pass filter (not shown) connected to the secondary side of the AC transformer 1602 allows the frequency component of the developing AC high-voltage waveform of the PWM signal to pass, and does not allow a high-frequency component to pass.

Here, explanation is given for a difference when 1500 [Vp−p] is output and when 0 [V] is output for drive waveforms that the full bridge circuit connected to the class-D amplifier 1601 outputs.

An example in which drive waveforms output to the terminals 1611 and 1612 of the primary side of the AC transformer 1602 when the AC high-voltage generation circuit 1411*a* according to the second embodiment outputs 1500 [Vp−p] are the same as in previously described FIG. 9.

In the 2 waveforms here, as illustrated by FIG. 9, a noise component is generated at a leading edge and a trailing edge of the rectangular waves. However, because for these 2 waveforms, as explained with reference to FIG. 18 and FIG. 19, the duty continuously fluctuates in accordance with the alternating current waveform signals that are inputted, the possibility of the noise component occurring at the same timing becomes lower and the noise component is suppressed to be lower. Meanwhile, the 2 drive waveforms output to the terminals 1611 and 1612 of the primary side of the AC transformer 1602 when the AC high-voltage generation circuit 1411*a* is in a standby state (0 [V]) are the same as in previously described FIG. 10. In such a case, because for the 2 waveforms the frequencies and duty (50%) are fixed, noise occurs at the same timings, and compared to the state of FIG. 9, the noise level worsens.

Also, the color image forming apparatus according to the second embodiment comprises 4 image forming stations of yellow, magenta, cyan, and black, and full bridge circuits in the class-D amplifiers in the image forming stations of respective colors are caused to operate simultaneously. For this reason, when the signals of the noise components of the class-D amplifiers for respective colors are overlapped, the noise level worsens more.

Here, spectrums of noise that is generated in a case where the respective class-D amplifiers in the 2 stations of yellow and magenta are driven at the same frequency are the same as in previously described FIG. 11. In this way, in a case where the respective class-D amplifiers of yellow and magenta are driven at the same frequency, noise peaks arise at the same frequency, the noise of the two colors is overlapped, and the noise peaks become larger.

Meanwhile, the spectrum of noise generated in the case where the 2 class-D amplifiers for yellow and magenta are driven at mutually differing frequencies is as is illustrated in previously described FIG. 12. In this way, if the class-D amplifiers for yellow and magenta are driven at mutually different frequencies, noise does not occur at the same timings, and therefore noises occurring in the driving circuits for the two colors are not overlapped. In this way, it is possible to suppress noise peaks to be lower compared with when the PWM signals of the class-D amplifiers for the two colors are driven at the same frequency.

An example of clock signals outputted by the oscillation circuit 1711 of 4 high-voltage circuits of yellow, magenta, cyan, and black in the color image forming apparatus according to the second embodiment is as in FIG. 13 similarly to the case of the previously described first embodiment.

In the second embodiment, because the frequencies of the clock signals of the oscillation circuit 1711 for respective colors are different from each other, and the frequencies of the clock signal are not the same for respective colors, the frequencies of the PWM signals of respective class-D amplifiers are not the same. Accordingly, because the noise component of the high-voltage for developing for each color does not occur at the same timing, it is possible to reduce radiation noise compared to when driving conventional class-D amplifiers as illustrated by FIG. 11.

Note that the frequencies of the PWM signals are determined by the value of the frequency adjustment resistor R2 connected to the oscillation circuit 1711, and in the second embodiment, the values of the frequency adjustment resistors R2 corresponding to respective colors are different from each other. Also, the values of the frequency adjustment resistor R2 are selected to be resistance values for which individual variation, temperature variation, and variation in internal capacitance of the oscillation circuit 1711 are considered, and even if error occurs, the frequencies of respective colors do not become the same. For example, the value of the frequency adjustment resistor R2 connected to the class-D amplifier that drives the AC transformer for yellow is assumed to be 30 kΩ±1%. Here, the resistance value for the frequency adjustment resistor R2 of the class-D amplifier for magenta, considering variation in internal capacitance of the oscillation circuit 1711, is set to a value so not to enter 30 kΩ±6%, in other words a range from 28.2 kΩ to 31.8 kΩ. Similarly, the resistances of the frequency adjustment resistor R2 connected to the class-D amplifiers for cyan and black are set so not to become the same as the resistances of the frequency adjustment resistor R2 connected to the class-D amplifiers for the other colors in accordance with error, variation, or the like.

By the second embodiment, as explained above, by causing the frequencies of the PWM signals that the class-D amplifiers for respective colors output to be different from each other, the signals of noise components generated in the class-D amplifiers of respective colors do not occur at the same timings. Thereby, compared to a case in which the frequencies of the PWM signals that the class-D amplifiers for respective colors output are the same, it is possible to reduce radiation noise.

In the second embodiment, explanation is given for a class-D amplifier by a full bridge circuit, but it is possible to achieve a similar effect even in the case of driving the transformers by a half-bridge.

Also, in the second embodiment, a class-D amplifier is used for each color of yellow, magenta, cyan and black, but the AC transformers for two colors may be driven simultaneously by 1 class-D amplifier. In this way, even if a configuration differs to the second embodiment, if the number of class-D amplifiers used is 2 or more, it is possible to achieve a similar effect.

[Third Embodiment]

Next, explanation will be given for a third embodiment of the present invention. In the third embodiment, the frequencies of the PWM signals are made to be modifiable when image forming and when in a standby state waiting for image forming. Here, the embodiment is for a case in which with respect to the frequency adjustment resistor R1 connected to the oscillation circuit 411 according to the first embodiment, another frequency adjustment resistor R2 is connected in parallel, and basic configuration is the same as in the first embodiment.

Figure 20:
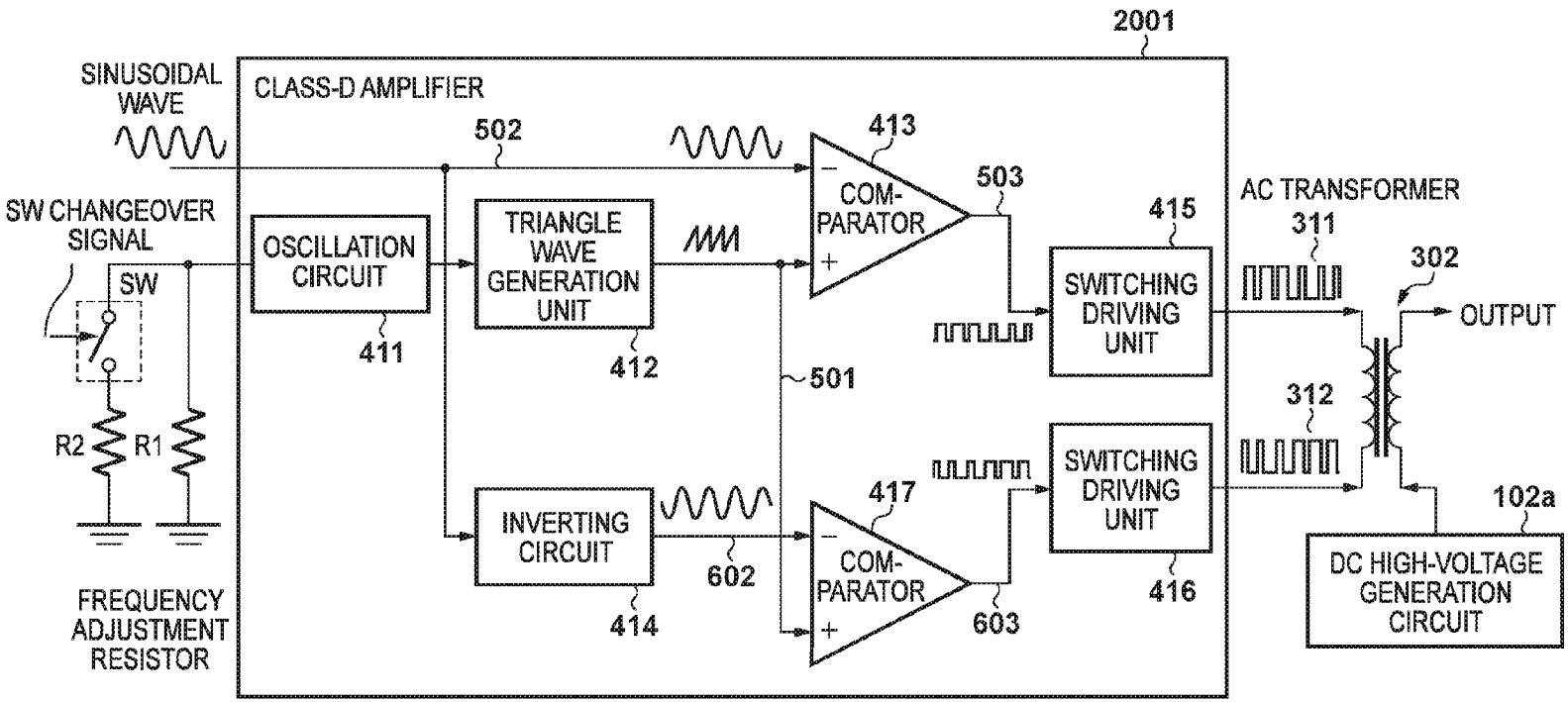
FIG. 20 is a block diagram for illustrating a configuration of the class-D amplifier according to a third embodiment.

FIG. 20 is a block diagram for illustrating a configuration of the class-D amplifier according to the third embodiment. In FIG. 20, portion common to previously described FIG. 4 are indicated by the same reference numerals. A class-D amplifier 2001 is included in the AC high-voltage generation circuit 101*a* of FIG. 2.

The class-D amplifier 2001 has a full bridge circuit including the oscillation circuit 411, the triangle wave generation unit 412, the comparator 413, the comparator 417, the inverting circuit 414, and the switching driving units 415 and 416. To the triangle wave generation unit 412, a clock signal of a frequency adjusted by the frequency adjustment resistors R1 and R2 is input from the oscillation circuit 411, and to the comparator 413 the triangle wave 501 output from the triangle wave generation unit 412 and the sinusoidal wave signal 502 are input as is. Also, to the comparator 417 the triangle wave 501 output from the triangle wave generation unit 412 and the sinusoidal wave signal 602 inverted through the inverting circuit 414 are input. The PWM signals 503 and 603 outputted from the comparators 413 and 417 are respectively inputted to the switching driving units 415 and 416, and the output of the switching driving units 415 and 416 is converted to a high-voltage by the AC transformer 302 and outputted. Next, explanation is given for an operation of each circuit block of FIG. 20.

The oscillation circuit 411 generates a clock signal with a frequency adjusted by a time constant for the frequency the frequency adjustment resistors R1 and R2 and a condenser C (not shown) in the oscillation circuit 411, and outputs it to the triangle wave generation unit 412. The triangle wave generation unit 412 synchronizes the clock signal from the oscillation circuit 411, generates the triangle wave 501 with a predetermined amplitude and outputs to the comparators 413 and 417. The comparator 413 compares the triangle wave 501 generated by the triangle wave generation unit 412 with the sinusoidal wave signal 502 inputted from the sinusoidal wave generation unit 300 as illustrated in previously described FIG. 5, and generates and outputs the PWM signal 503.

Meanwhile, the comparator 417, as illustrated in FIG. 6 described previously, compares the triangle wave 501 generated by the triangle wave generation unit 412 with the sinusoidal wave signal 602 inverted through the inverting circuit 414, and generates and outputs the PWM signal 603.

Each of the PWM signals 503 and 603 is inputted to the full bridge circuit including the switching driving unit 415 and the switching driving unit 416. The switching driving unit 415 outputs a drive voltage to a primary side terminal 311 of the AC transformer 302, and the switching driving unit 416 outputs a drive voltage to a primary side terminal 312 of the AC transformer 302. An electric current flows between the primary side terminals 311 to 312 of the AC transformer 302 by electric potential difference of the output voltages of the switching driving units 415 and 416, and an AC high-voltage is generated on the secondary side of the AC transformer 302. The AC high-voltage for charging generated in this way is inputted to a capacitive load C consisting of the charging roller 2 and the photosensitive drum 1.

Here, explanation is given for a difference when 1500 [Vp−p] is output and when 0 [V] is output for the drive waveforms that the full bridge circuit connected to the class-D amplifier outputs.

Here, an example in which drive waveforms output to the terminals 311 and 312 of the primary side of the AC transformer 302 when the AC high-voltage generation circuit 101 outputs 1500 [Vp−p] are as is illustrated in previously described FIG. 9. In the 2 waveform here, as illustrated by FIG. 9, a noise component is generated at a leading edge and a trailing edge of the rectangular waves. However, in the third embodiment, as illustrated by FIG. 5 and FIG. 6, for the PWM signals that drive the AC transformer 302, the duty fluctuates for respective colors. For this reason, the possibility that the timings at which the noise components of the charging voltages for respective colors occur will become the same becomes lower, and because the noise components of respective colors being overlapped can be reduced, it is possible to suppress noise to be lower.

Meanwhile, the 2 drive waveforms output to the terminals 311 and 312 of the primary side of the AC transformer 302 when the high-voltage generation circuit 101 is in a standby state (0[V]) are the same as is illustrated in previously described FIG. 10. Because for these 2 waveforms, as explained in FIG. 7, the frequencies of the PWM signals and the duty (50%) are both fixed, compared to the state of FIG. 9, the noise level worsens.

Figure 21:
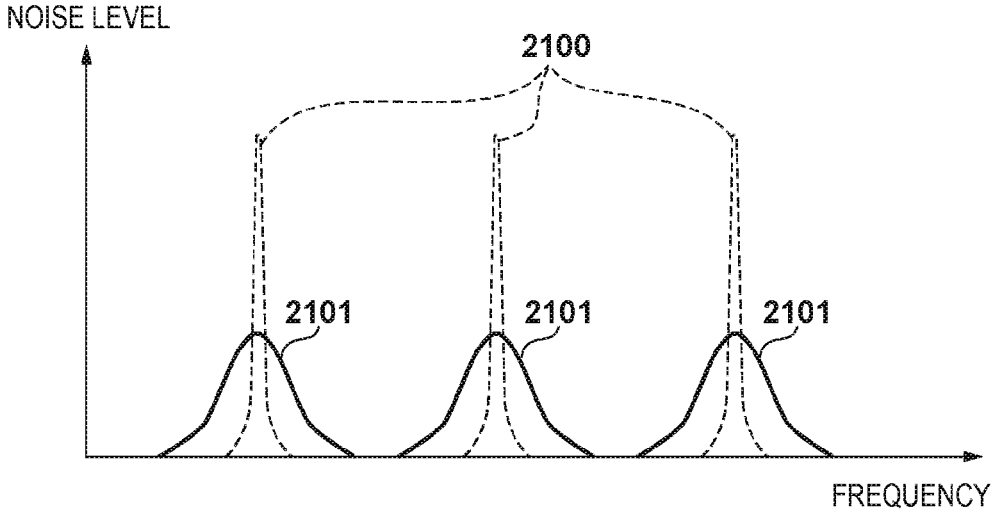
FIG. 21 depicts a view for illustrating an example of generated noise spectrums when a duty of an output of a full bridge circuit connected to a class-D amplifier according to the third embodiment fluctuates, and upon a fixed frequency and a fixed duty.

FIG. 21 depicts a view for illustrating an example of generated noise spectrum when a duty of an output of a full bridge circuit connected to the class-D amplifier according to the third embodiment fluctuates, and for when there is a fixed frequency and a fixed duty.

When the voltage circuits for charging for respective colors are driven by a fixed frequency and a fixed duty, as is denoted by reference numeral 2100, noise peaks occur at a fixed frequency. In contrast to this, when the duties of the signals driving the voltage circuits for respective colors vary, the noise becomes broad as denoted by reference numeral 2101.

Also, the color image forming apparatus according to the third embodiment comprises 4 image forming stations of yellow, magenta, cyan, and black, and in the image forming stations of respective colors, a full bridge circuit in a class-D amplifier is caused to operate simultaneously. For this reason, when the signals of the noise components of the charging voltages for respective colors are overlapped, the noise level worsens more.

Here, an example of spectrums of noise that are generated in a case where the class-D amplifiers in the image forming stations for yellow and magenta are driven at the same frequency upon standby are the same as is illustrated in previously described FIG. 11. In this way, in a case where the class-D amplifiers for yellow and magenta are driven at the same frequency, noise peaks arise at the same frequency, the signals of the noise components of the two colors are overlapped, and the noise peaks become larger.

Meanwhile, the example of the spectrums of noise generated in the case where the 2 class-D amplifiers for yellow and magenta are driven at mutually differing frequencies upon standby is as is illustrated in previously described FIG. 12. In this way, if the class-D amplifiers for yellow and magenta are driven at mutually different frequencies, noise peaks do not arise at the same frequency, and therefore noises of the power supplies for the two colors are not overlapped. In this way, it is possible to suppress noise peaks to be lower compared with when the PWM signals of the class-D amplifiers for the two colors are made to be of the same frequency.

Figure 22:
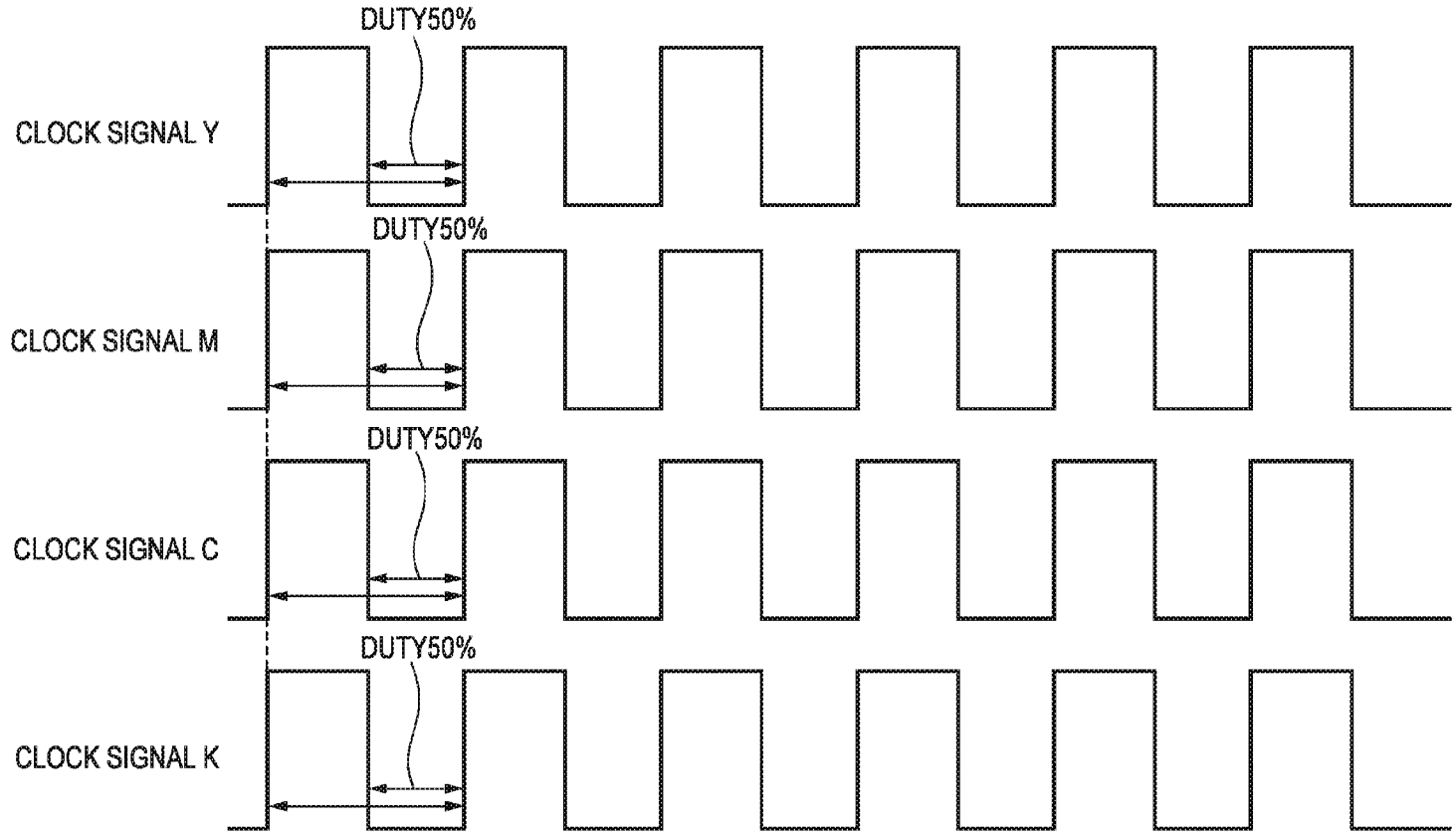
FIG. 22 depicts a view for illustrating an example of clock signals outputted during image formation by four oscillation circuits of high-voltage circuits for yellow, magenta, cyan, and black in a color image forming apparatus according to the third embodiment.

FIG. 22 depicts a view for illustrating an example of clock signals outputted during image formation by the oscillation circuit 411 of the four high-voltage circuits for yellow, magenta, cyan, and black in the color image forming apparatus according to the third embodiment.

Figure 23:
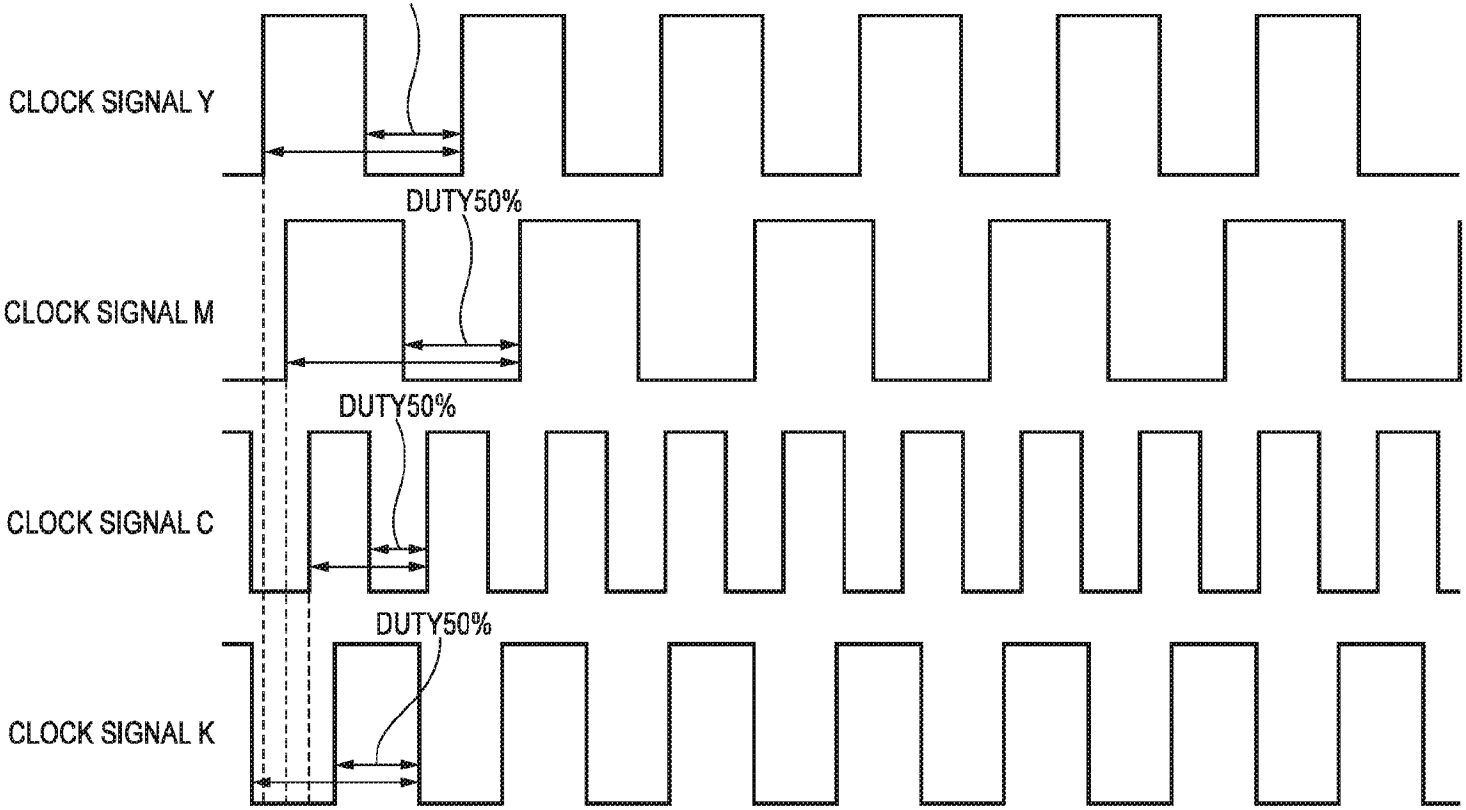
FIG. 23 depicts a view for illustrating an example of clock signals outputted during standby by four oscillation circuits of high-voltage circuits for yellow, magenta, cyan, and black in the color image forming apparatus according to the third embodiment.

FIG. 23 depicts a view for illustrating an example of clock signals outputted during standby by the oscillation circuit 411 of the four high-voltage circuits for yellow, magenta, cyan, and black in the color image forming apparatus according to the third embodiment.

In the third embodiment, during standby, the frequencies of the clock signals of the oscillation circuit 411 driving the voltage generation circuits for respective colors differ from each other. For this reason, the frequencies of the clock signals differ from each other for respective colors during standby, and the frequencies for the PWM signals of the class-D amplifiers for respective colors differ from each other. Accordingly, because the noise components of the voltage generation circuits for respective colors do not occur at the same period, it is possible to reduce radiation noise compared to when driving conventional class-D amplifiers as illustrated by previously described FIG. 11.

Switching of the frequencies of the PWM signals during standby is performed by switching a connection of the frequency adjustment resistors R1 and R2 connected to the oscillation circuit 411 of FIG. 20 by a switching element SW. The switching of the switching element SW is performed by an SW changeover signal outputted by the CPU 202 of FIG. 2. When the color image forming apparatus according to the third embodiment enters a standby state, the SW changeover signal is outputted from the CPU 202, the switching element SW is turned on, and a parallel circuit of the oscillation circuit 411 and the frequency adjustment resistors R1 and R2 is formed.

Next, when the image forming apparatus enters an image forming state, the switching element SW is turned off by the SW changeover signal, and the oscillation circuit 411 and the frequency adjustment resistor R1 are connected. In the third embodiment, the resistance value of the frequency adjustment resistor R1 is the same in the image forming stations for respective colors, and the resistance value of R2 mutually differs in the image forming stations for respective colors. Accordingly, when the switching element SW is turned on, the parallel circuit of the frequency adjustment resistors R1 and R2 is formed, and for each of the image forming stations for the respective colors, the frequency of the clock signal that the oscillation circuit 411 outputs is different. As a result, the frequencies of the PWM signals and the duties previously described differ for each of the image forming stations for the respective colors, and a noise signal overlap as illustrated in FIG. 11 can be suppressed.

Also, the resistance value when the frequency adjustment resistors R1 and R2 configure the parallel circuit is selected to be a resistance having a value for which individual variation, a temperature variation, and variation in the internal capacitance of the oscillation circuit 411 are considered, and so the frequencies of the PWM signals of respective colors do not become the same. For example, the resistance value when the frequency adjustment resistors R1 and R2 connected to the class-D amplifier that drive the AC transformer for yellow configure the parallel circuit is assumed to be 30 kΩ±1%. Here, in the class-D amplifier for magenta, considering variation in the internal capacitance of the oscillation circuit 411, the resistance value when R1 and R2 form the parallel circuit is selected to be a value so not to enter a 30 kΩ±6%, in other words a range from 28.2 kΩ to 31.8 kΩ. Similarly, the values of the resistances of the parallel circuit of the frequency adjustment resistors R1 and R2 connected to the class-D amplifier for cyan and black are selected so not to become the same as the values of the resistances of the parallel circuits of R1 and R2 connected to the class-D amplifiers for the other colors in accordance with error, variation, or the like.

Also, by reducing the frequencies of the PWM signal when the image forming apparatus is in standby, the number of operations for driving by the switching driving units 415 and 416 can be reduced, and it is possible to further reduce the occurrence of noise. For the frequencies of the PWM signals during standby, for example, a resistance value of the parallel circuit of the frequency adjustment resistors R1 and R2 is selected so that they become about 300 kHz.

By virtue of the third embodiment as explained above, it is possible to configure so that signals of noise components do not occur at the same period by setting the frequencies of the PWM signals that the class-D amplifier outputs for respective colors when the image forming apparatus is in standby to be frequencies that differ from each other. Thereby, compared to a case in which the frequencies of the PWM signals that the class-D amplifiers driven for respective colors output during standby are the same, it is possible to reduce radiation noise.

Also, by selecting a resistance of the parallel circuit of the frequency adjustment resistors R1 and R2 so that the frequencies of the PWM signals are lower when the image forming apparatus is in standby, the number of operations for driving by the switching driving units 415 and 416 can be reduced, and it is possible to further reduce the occurrence of noise.

Figure 24:
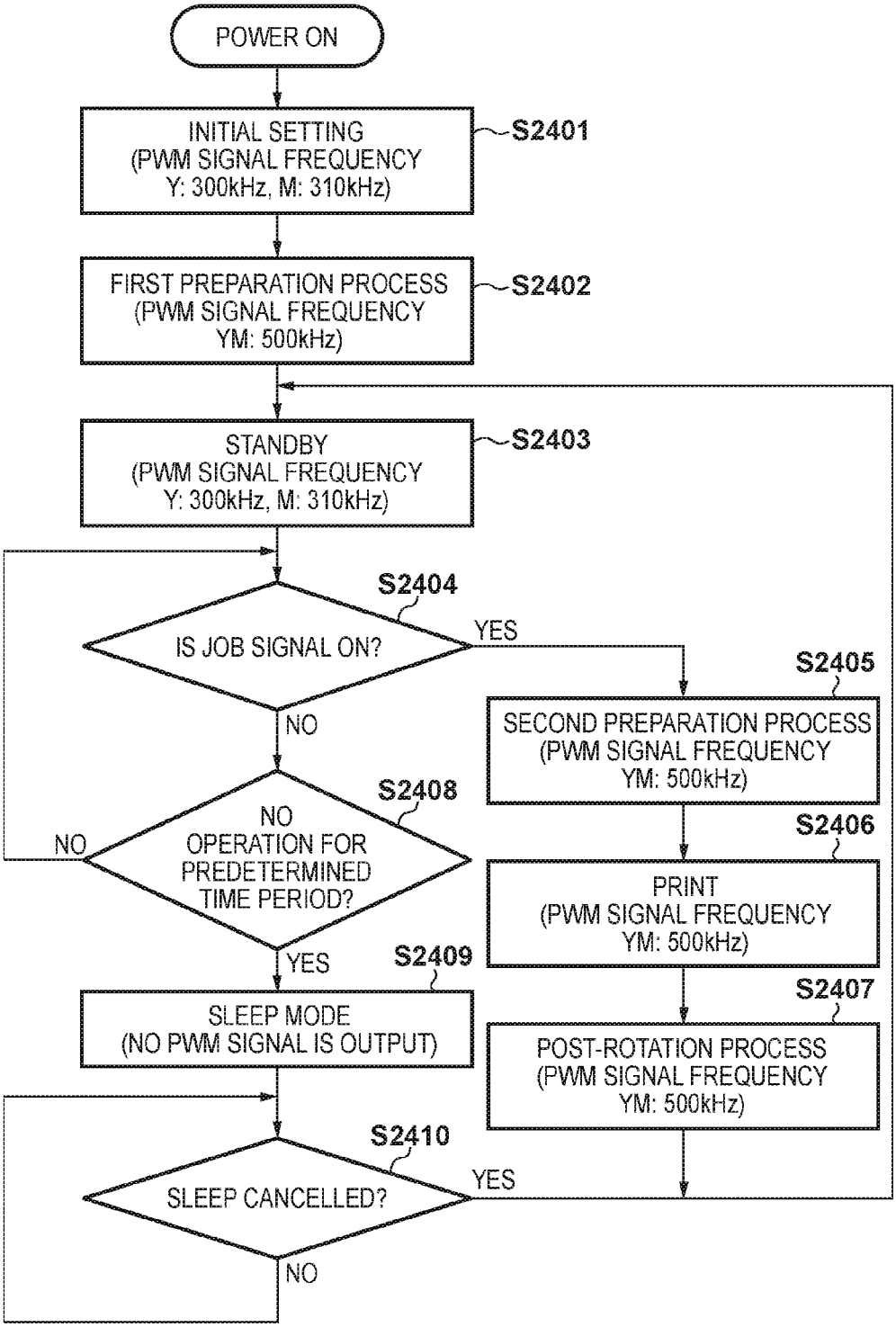
FIG. 24 is a flowchart for describing control processing by a CPU of the color image forming apparatus according to the third embodiment.

FIG. 24 is a flowchart for describing control processing by the CPU 202 of the color image forming apparatus according to the third embodiment. The color image forming apparatus comprises image forming stations for the four colors of yellow, magenta, cyan, and black, but explanation is given for a case where the frequencies of the PWM signals of yellow and magenta are caused to differ from each other. Note that a program for executing this processing is stored in the memory 203, and by the CPU 202 executing this program, the processing illustrated by this flowchart is realized.

This processing is started by a switch of a main power supply of the image forming apparatus being turned on, and power being supplied to each unit of the image forming apparatus. Firstly, in step S2401, the CPU 202 performs an initial setting for environment settings or the like. Here, the CPU 202 turns on the switching element SW by the SW changeover signal, and the parallel circuit of the resistors R1*a* and R2*a* connected to the oscillation circuit 411*a* that generates the PWM signals for yellow is caused to be formed. Also, the parallel circuit of the resistors R1*b* and R2*b* connected to the oscillation circuit 411*b* that generates the PWM signals for magenta is caused to be formed. Because the resistance values of the resistors R2*a* and R2*b* are different to each other, the frequencies for the PWM signals in the class-D amplifier for respective colors of yellow and magenta are set to be different frequencies in the proximity of 300 kHz respectively. For example, the frequencies of the PWM signals for yellow and magenta are set to be 300 kHz and 310 kHz respectively, for example.

Thus, when the initial setting ends, the processing proceeds to step S2402, and the CPU 202 performs control for start-up upon power supply activation (a first preparation process). Here, the CPU 202 turns off the switching element SW by the SW changeover signal, and a state is entered in which the oscillation circuit 411*a* and the resistor R1*a* are connected, and the resistor R1*b* is connected to the oscillation circuit 411*b*. The resistance values of the resistors R1*a* and R1*b* are the same, and the frequencies for the PWM signals in the class-D amplifiers for respective colors of yellow and magenta are set to be 500 kHz, for example.

When this first preparation process ends, the processing proceeds to step S2403, and the CPU 202 transitions to a standby state in which it stands by for image forming. During this standby, the CPU 202 outputs the SW changeover signal to turn on the switching element SW, and as described above, the frequencies of the PWM signals for yellow and magenta are respectively set to 300 kHz and 310 kHz. In other words, because when the image forming apparatus is in standby, the frequencies of the PWM signals of the class-D amplifiers for respective colors are different from each other, and it is possible to reduce the noise level compared to when the frequencies of the PWM signal of the voltage generation circuits for respective colors are the same.

Next, the processing proceeds to step S2404, and the CPU 202 determines whether or not an instruction to start a job for image forming is input; when it is determined that a start instruction is input, the processing proceeds to step S2405, and otherwise the processing proceeds to step S2408. In step S2405, the CPU 202 executes a setting for image formation (a second preparation process), and next, the processing proceeds to step S2406, and image formation processing is performed. In this image formation processing, the CPU 202 turns off the switching element SW by the SW changeover signal. Thereby, the frequencies of the PWM signals of the class-D amplifiers for respective colors are set to the same 500 kHz. Also, at this time, because the AC voltage for charging outputs 1500 [Vp−p], the duties of the PWM signals output from the class-D amplifiers for respective colors differ from each other as is illustrated in FIG. 9. Accordingly, the noise generated in the voltage for each color does not overlap the noise generated in the voltages of the other colors, and it is possible to suppress peaks of noise to be lower. Thus, when the image forming ends, the processing proceeds to step S2407, and the CPU 202 performs control for after image forming terminates (post-rotation process). Then, when this post-rotation process terminates, the processing proceeds to step S2403, and transition is made into the standby state. When the standby state is transitioned into, the CPU 202 turns on the switching element SW by the SW changeover signal. Thereby, the frequencies of the PWM signals of the class-D amplifiers for respective colors become 300 kHz and 310 kHz respectively.

Meanwhile, when in step S2404 the CPU 202 determines that the instruction to start a job is not input, the processing proceeds to step S2408. In step S2408, the CPU 202 determines whether or not in the standby state, a state in which no operation is performed continues for a predetermined time period, and if a state in which there was no operation for the predetermined time period has not continued, the processing proceeds to step S2404. When, in step S2408, the CPU 202 determines that a state in which no operation was performed has continued for the predetermined time period, the processing proceeds to step S2409, the CPU 202 outputs a sleep signal for causing transition into a power saving state, stops the supply of power to the high-voltage substrate 200, and transitions into a sleep mode. Then, the processing proceeds to step S2410, and in the sleep mode state, external input of a signal for operation is awaited, and when a signal for operation is input, the sleep mode is cancelled, and the processing returns to step S2403.

Because the frequencies of the PWM signals for respective colors are different from each other when the image forming apparatus is in standby owing to performing the control explained above, it is possible to reduce the noise level compared to when the frequencies of the PWM signals for respective colors are the same.

Note that in the third embodiment, explanation is given for a case in which the frequencies of the PWM signals of the class-D amplifiers for yellow and magenta are caused to be different from each other, but actually it is advantageous to cause the frequencies of the PWM signals of the class-D amplifiers for the four colors of yellow, magenta, cyan and black to be different from each other.

In the third embodiment, explanation is given for full bridge output as a class-D amplifier, but it is possible to achieve a similar effect even in the case of driving the transformers by a half-bridge.

Also, in the third embodiment, the class-D amplifiers are used for the colors yellow, magenta, cyan and black. However, the present invention is not limited to this, and for example, AC transformers of two colors may be simultaneously driven by 1 class-D amplifier. In this way, even if a configuration differs to the first embodiment, if the number of class-D amplifiers used is plural, it is possible to achieve a similar effect by employing a similar configuration.

Embodiments of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiments and/or that includes one or more circuits (e.g., application specific integrated circuit (ASIC)) for performing the functions of one or more of the above-described embodiments, and by a method performed by the computer of the system or apparatus by, for example, reading out and executing the computer executable instructions from the storage medium to perform the functions of one or more of the above-described embodiments and/or controlling the one or more circuits to perform the functions of one or more of the above-described embodiments. The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

Note, the present invention is not limited to the embodiment described above, and it is possible to make various modifications or changes without straying from the spirit and scope of the present invention. Accordingly, the following claims are attached to make public the scope of the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-263347, filed Dec. 25, 2014 which is hereby incorporated by reference herein in its entirety.

What is claimed is:

1. An image forming apparatus comprising:

a plurality of image forming units configured to respectively form an image;

a plurality of voltage generation units configured to respectively generate voltages for driving the plurality of image forming units, wherein each of the plurality of voltage generation units comprises:

a voltage generator having a transformer, configured to generate a voltage by a switching operation that is driven by changing an input voltage of primary side of the transformer;

a clock generation unit configured to generate a clock signal of a frequency that becomes a reference frequency of the switching operation;

a setting unit configured to set the frequency of the clock signal that the clock generation unit generates; and a control unit configured to control so that the frequencies of the clock signals are set by the setting unit to values that are different from each other when the image forming apparatus is in image forming and in a standby state in which the image forming apparatus is waiting for start of image forming.

2. The image forming apparatus according to claim 1, wherein the setting unit sets the frequency of the clock signal that the clock generation unit generates by varying a value of a resistance connected to the clock generation unit.

3. The image forming apparatus according to claim 2, wherein the setting unit has a first resistor connected to the clock generation unit, and a second resistor connected via a switching element to the clock generation unit, and the control unit sets the frequency of the clock signal that the clock generation units generate by switching a connection by the switching element.

4. The image forming apparatus according to claim 1, wherein the control unit controls so that in the standby state, the frequency of the clock signal that the clock generation unit generates is set to a frequency that is lower than in the image forming.

5. The image forming apparatus according to claim 1, wherein the voltage generator comprises:

a switching circuit connected to a primary side of the transformer; and a generation unit configured to output a pulse width modulation signal for driving the switching circuit in synchronization with the clock signal.

6. The image forming apparatus according to claim 5, wherein the generation unit comprises:

a first comparator configured to compare a sinusoidal wave signal of a predetermined frequency and a triangle wave generated in synchronization to the clock signal and to output a first pulse width modulation signal; and a second comparator configured to compare a signal in which the sinusoidal wave signal is inverted and the clock signal, and to output a second pulse width modulation signal, wherein the switching circuit inputs the first and second pulse width modulation signals, and drives terminals on the primary side of the AC transformer.

7. The image forming apparatus according to claim 6, further comprising a sinusoidal wave generation unit configured to generate the sinusoidal wave signal of the predetermined frequency.

8. The image forming apparatus according to claim 7, the each of the plurality of voltage generation units further comprising a detection unit configured to detect a voltage that the voltage generator generates, wherein the sinusoidal wave generation unit adjusts an amplitude of the sinusoidal wave signal in accordance with a voltage value detected by the detection unit.

9. An image forming apparatus comprising:

a plurality of image forming units configured to respectively form an image; and a plurality of voltage generators configured to respectively generate voltages for supplying the plurality of image forming units, wherein each of the plurality of voltage generators comprises:

a sinusoidal wave generator configured to generate a sinusoidal wave;

a transformer configured to generate a high voltage at a secondary side of the transformer; and a class-D amplifier having a clock generator for generating a clock signal, the class-D amplifier being configured to generate a PWM signal for driving a primary side of the transformer based on the sinusoidal wave generated by the sinusoidal wave generator and the clock signal, wherein the frequencies of the PWM signals generated by the respective class-D amplifiers of the plurality of voltage generators differ from each other so that the PWM signals generated by the respective class-D amplifiers do not synchronize with each other even if a duty of each of the PWM signals generated by the respective class-D amplifiers becomes a same predetermined value.

10. The image forming apparatus according to claim 9, wherein each of the plurality of voltage generators includes a resistor which sets the frequency of the generated voltage, the resistor being connected to the clock generator, and resistance values of the resistor differ between the plurality of voltage generators.

11. The image forming apparatus according to claim 9, wherein the image forming unit forms an image by an electrophotographic method, and the voltage generator generates a charging voltage of the image forming unit.

12. The image forming apparatus according to claim 9, wherein the image forming unit forms an image by an electrophotographic method, and the voltage generator generates a developing voltage of the image forming unit.

13. The image forming apparatus according to claim 9, wherein the plurality of image forming units form images of yellow, magenta, cyan and black, respectively.

14. The image forming apparatus according to claim 9, each of the plurality of voltage generators further comprising a voltage detector configured to detect an output voltage of the transformer and feedback the output voltage to the sinusoidal wave generator, wherein the sinusoidal wave generator further changes the amplitude of the generated sinusoidal wave in accordance with the feedback by the voltage detector.

* * * * *